US007932010B2

(12) United States Patent
Yamada et al.

(10) Patent No.: US 7,932,010 B2
(45) Date of Patent: Apr. 26, 2011

(54) TONER, METHOD OF MANUFACTURING THE SAME, TWO-COMPONENT DEVELOPER, DEVELOPING DEVICE, AND IMAGE FORMING APPARATUS

(75) Inventors: Saori Yamada, Neyagawa (JP); Yoshitaka Kawase, Nara (JP); Yoshiaki Akazawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 169 days.

(21) Appl. No.: 12/249,257

(22) Filed: Oct. 10, 2008

(65) Prior Publication Data

US 2009/0098475 A1 Apr. 16, 2009

(30) Foreign Application Priority Data

Oct. 11, 2007 (JP) ..... P2007-265868

(51) Int. Cl.
*G03G 9/097* (2006.01)

(52) U.S. Cl. ..... 430/137.11; 430/137.1; 430/137.14

(58) Field of Classification Search ..... 430/110.1, 430/110.2, 108.1, 137.1, 137.14, 137.18, 430/137.11

See application file for complete search history.

(56) References Cited

U.S. PATENT DOCUMENTS

| | | | | |
|---|---|---|---|---|
| 5,429,901 | A | 7/1995 | Muto et al. | |
| 2004/0110077 | A1 * | 6/2004 | Yachi et al. | 430/108.6 |

FOREIGN PATENT DOCUMENTS

| | | |
|---|---|---|
| JP | 01-185649 | 7/1989 |
| JP | 02-001875 | 1/1990 |
| JP | 04-141665 | 5/1992 |
| JP | 04-182662 | 6/1992 |
| JP | 6-130726 A | 5/1994 |
| JP | 2004-109406 | 4/2004 |

OTHER PUBLICATIONS

Abstract of JP 1185649, Jan. 1984.*
English langauge translation of JP 01185649, Jul. 1989.*

* cited by examiner

*Primary Examiner* — Hoa V Le
(74) *Attorney, Agent, or Firm* — Nixon & Vanderhye P.C.

(57) ABSTRACT

There are provided a toner, a method of manufacturing the toner, a two-component developer, a developing device, and an image forming apparatus, which are excellent in a charge rising property, environmental stability, and life stability during printing and which cause less fogging. The toner contains a core particle containing binder resin and colorant, and a coating layer which contains resin and a charge control agent and is formed on a surface of the core particle. At least a part of the resin contained in the coating layer is melt-bonded to the core particle, and the charge control agent is dispersed and immobilized in the coating layer. The dispersed charge control agent has a dispersion diameter of less than 1 μm.

9 Claims, 3 Drawing Sheets

TONER, METHOD OF MANUFACTURING THE SAME, TWO-COMPONENT DEVELOPER, DEVELOPING DEVICE, AND IMAGE FORMING APPARATUS

CROSS-REFERENCE TO RELATED APPLICATION

This application claims priority to Japanese Patent Application No. 2007-265868, which was filed on Oct. 11, 2007, the contents of which are incorporated herein by reference in its entirety.

BACKGROUND OF THE INVENTION

1. Field of the Invention

The present invention relates to a toner which is used to develop an electrostatic latent image in an image forming apparatus employing an electrophotographic process or electrostatic printing process, as well as to a method of manufacturing the toner, a two-component developer, a developing device, and an image forming apparatus.

2. Description of the Related Art

A toner is used to visualize a latent image in various image forming processes, and one known example thereof is an electrophotographic image forming process.

In an electrophotographic image forming apparatus, an image is formed by way of the steps of charging, exposure, developing, transferring, and fixing. First of all, in the charging step, a surface of a photoreceptor is uniformly charged. The photoreceptor serves as an image bearing member on which an electrostatic latent image is to be formed. In the exposure step, the charged surface of the photoreceptor is irradiated with light corresponding to image information so that an electrostatic latent image is formed on the surface of the photoreceptor. In the developing step, a toner is attached optionally to the electrostatic latent image formed as above so that an image visualized with toners (toner image) is formed on the surface of the photoreceptor. And in the transferring step, the toner image is transferred onto a transfer sheet by electrical attraction. In the final fixing step, the toner image transferred on the transfer sheet has its toner molten by heat so that the toner image is fixed to the transfer sheet.

As a color imaging technique has been rapidly advanced in the electrophotographic process, a full-color image forming apparatus has been developed and now available in the market. The market scale of the full-color image forming apparatus is expanding along with prevailing black-and-white image forming apparatus. In reproducing colors in the full-color image forming apparatus, it is common to use three subtractive primary colors; yellow (Y), magenta (M), and cyan (C), or four colors composed of the above three colors and black (K). The colors are reproduced in the following procedures. Among the image forming steps, the steps of charging, exposure, developing, and transferring, are repeated for respective colors of C, M, Y, and K so that toner images made of plural colors overlap one another on the transfer sheet, thus forming a full-color image. And in the final fixing step, the above overlapping toner images are fixed to the transfer sheet with the toners being molten thereon. In the procedure just described, the molten toners constituting the overlapping toner images are mixed with each other, with the result that the colors are reproduced based on the subtractive principles.

In the full-color electrophotographic process as described above, the development is conducted more than once and in the fixing step, a plurality of toner images different in color need to be overlaid with one another on the same support, which fact grows importance of expected chargeability, fluidity, and fixing property of the toners in respective colors.

That is to say, in order to maintain stable and favorable color reproducibility for full-color images, predetermined amounts of the toners need to be firstly attached to surfaces of photoreceptors in the developing step, and all of the toners need to be then transferred onto a transfer sheet. The amounts of the toners in the developing step and the transferring step are greatly influenced by the charging properties of the toners such as a charge rising property, and environmental stability and temporal stability of charge amounts in the toner.

For that reason, the toner contains a charge control agent with binder resin, colorant, etc., to improve and adjust the charge amount.

It is known that it is important to uniformly and finely disperse the charge control agent into toner particles or in surfaces of toner particles in order to provide the toner with excellent charging properties.

The toner containing the charge control agent in the toner particles used to have a problem that the charge control agent partially aggregates in the toner or is made not fine enough and exist in form of coarse particles even when uniformly dispersed, thereby causing troubles such as a failure to obtain a sufficient amount of initial charges, a defective charge rising property, or serious charge decay.

Various efforts have therefore been made to uniformly and finely disperse the charge control agent into the toner, but it is difficult to uniformly and finely disperse the charge control agent into the toner and moreover, it is difficult to have the charge control agent optionally exist in the surfaces of toner particles which are important for contact electrification with a charging member or a carrier.

To overcome such difficulties, there has been proposed a method of immobilizing the charge control agent in the surfaces of the toner particles. For example, in Japanese Unexamined Patent Publication JP-A 1-185649 (1989), a mechanical impact is applied and thereby synthetic resin containing a charge control agent is attached to surfaces of toner particles containing colorant and synthetic resin.

In Japanese Unexamined Patent Publication JP-A 2004-109406, fine resin particles are dipped into a solution having a charge control agent dissolved therein, and then dried to deposit the charge control agent, and the fine resin particles are immobilized in toner particles by a mechanical impact.

In Japanese Unexamined Patent Publication JP-A 4-182662 (1992), fine resin particles and a charge control agent are attached to toner particles by a mechanical impact, and to the toner particles thus obtained, a solution is sprayed and then dried inside a hot-air drier.

In each of the toners disclosed in JP-A 1-185649 (1989), JP-A 2004-109406, and JP-A 4-182662 (1992), the charge control agent and the fine resin particles are attached, bonded, or melt-bonded to the toner particles, allowing for enhancement in the chargeability of the toner.

The toners disclosed in JP-A 1-185649 (1989), JP-A 2004-109406, and JP-A 4-182662 (1992), however, have the following problems to be solved.

In the toner disclosed in JP-A 1-185649 (1989), the mechanical impact generated by a commonly-used mixer, e.g., a hybridizer, is used to let the fine resin particles and the charge control agent be buried in and bonded to the toner particles. Since these fine resin particles and charge control agent are immobilized not firmly in the toner particles, the fine resin particles and the charge control agent may fall off the toner particles during the long-term use, for example, by agitation inside a developing container, thus decreasing life stability of charges.

Also in the toner disclosed in JP-A 2004-109406, the mechanical impact is applied and thereby the fine resin particles having the charge control agent attached thereto are buried in and bonded to the toner particles. Since these fine resin particles and charge control agent are immobilized not firmly in the toner particles, the fine resin particles and the charge control agent may undesirably fall off the toner particles during the long-term use, for example, by agitation inside a developing container.

In JP-A 4-182662 (1992), the fine resin particles are attached to the toner by the mechanical impact and then, the solution is sprayed to the toner thus obtained, and therefore the fine resin particles and the charge control agent are immobilized firmly in the toner particles as compared to the toners disclosed in JP-A 1-185649 (1989) and JP-A 2004-109406. However, no mechanical impact is applied in the step of spraying the solution, and a coating layer containing the fine resin particles and the charge control agent is not melt-bonded and fixed to the toner particles and therefore, the fine resin particles and the charge control agent may undesirably fall off the toner particles during the long-term use, for example, by agitation inside a developing container.

SUMMARY OF THE INVENTION

An object of the invention is to provide a toner, a method of manufacturing the toner, a two-component developer, a developing device, and an image forming apparatus, which are excellent in charge rising property, environmental stability, and life stability during printing and which cause less fogging.

The invention provides a toner comprising:

a core particle containing binder resin and colorant; and a coating layer containing resin and a charge control agent, formed on a surface of the core particle, the resin contained in the coating layer having at least a part thereof melt-bonded to the core particle, and the charge control agent being dispersed and immobilized in the coating layer, and the dispersed charge control agent having a dispersion diameter of less than 1 μm.

According to the invention, the coating layer containing the resin and the charge control agent is formed on the surface of the core particle containing the binder resin and the colorant, with the result that a toner surface layer has the charge control agent, which enhances a charge rising property of the toner. Moreover, at least a part of the resin is melt-bonded to the core particle, resulting in a toner in which the coating layer is firmly bonded to the core particle. The toner has the charge control agent immobilized in the coating layer and therefore is excellent in the environmental stability and life stability during printing, and causes less fogging.

According to the invention, the charge control agent is dispersed in the coating layer, with the result that the toner is excellent in the environmental stability and life stability during printing and causes less fogging.

Moreover, the charge control agent is dispersed in the coating layer, and the dispersed charge control agent has a dispersion diameter of less than 1 μm. As a result, the charge control agent becomes less likely to aggregate and thereby able to be uniformly dispersed in the surfaces of the core particles. In addition, the change control agent is prevented from falling off the core particles, therefore leading to enhancement in the charge rising property, the environmental stability, and the life stability during printing. The dispersed charge control agent, which has a dispersion diameter of 1 μm or more, will easily fall off the core particles.

Further, in the invention, it is preferable that the resin contained in the coating layer is formed of fine resin particles, and at least a part of the fine resin particles is melt-bonded to adjacent fine resin particles.

As a result, the fine resin particles are integrated with each other so that a solid coating layer is formed. Moreover, not only the fine resin particles but also the charge control agent is firmly melt-bonded to the core particle surface, with the result that the charge control agent is less likely to fall off, allowing for high charging stability during the whole life time of the toner.

Further, in the invention, it is preferable that a surface area of the core particle covered with the coating layer is 80% or more and 100% or less of a total surface area of the core particle.

According to the invention, the surface area of the core particle covered with the coating layer is preferably 80% or more and 100% or less of the total surface area of the core particle. This enhances a charge rising property, environmental stability, and life stability during printing. If the surface area of the core particle covered with the coating layer is less than 80%, the core particle has its larger surface area exposed, which delays an initial rise of charges and deteriorates the environmental stability.

Further, in the invention, it is preferable that a content of the charge control agent is 1 part by weight or more and 100 parts by weight or less based on 100 parts by weight of the fine resin particles.

According to the invention, the content of the charge control agent is preferably is 1 part by weight or more and 100 parts by weight or less based on 100 parts by weight of the fine resin particles. This enhances the charge rising property, the environmental stability, and the life stability during printing.

Further, in the invention, it is preferable that the charge control agent is at least one or more of metal complex or metal salt of salicylic acid and a derivative thereof, metal complex or metal salt of bisdiphenylglycolic acid and a derivative thereof, and charge control resin.

According to the invention, the charge control agent is preferably at least one or more of metal complex or metal salt of salicylic acid and a derivative thereof, metal complex or metal salt of bisdiphenylglycolic acid and a derivative thereof, and charge control resin. These charge control agents have high transparency and are therefore capable of forming clearer images.

The invention provides a method of manufacturing the above-mentioned toner, comprising:

bringing fine resin particles and a charge control agent into contact with core particles in the presence of an adhesion aiding agent for increasing adhesion of the fine resin particles and charge control agent to the core particles.

According to the invention, in the method of manufacturing the toner having the effects as described above, the fine resin particles and the charge control agent are brought into contact with the core particles in the presence of the adhesion aiding agent which increases the adhesion of the fine resin particles and charge control agent to the core particles.

The adhesion aiding agent for increasing the adhesion of the fine resin particles and charge control agent to the core particles enhances wettability of the fine resin particles to the core particle, thereby making it easy to form the coating layer containing the fine resin particles over an entire surface or large surface part of the core particle. The coating layer thus formed is less likely to fall off the core particle owing to the fine resin particles which are melt-bonded to the core particle.

Moreover, the charge control agent can be dispersed into such a coating layer firmly attached to the core particle, and therefore are also less likely to fall off the core particle. Accordingly, the coating layer is prevented from falling off in the long-term use so that the toner is prevented from changing in properties, resulting in enhancement in the charge rising property, the environmental stability, and the life stability during printing.

Further, in the invention, it is preferable that the core particles have a volume average particle size of 3 μm or more and 10 μm or less.

According to the invention, the core particles preferably have a volume average particle size of 3 μm or more and 10 μm or less. This allows for stable formation of high-definition images over a long period of time.

Further, in the invention, it is preferable that the fine resin particles have a volume average particle size of 0.05 μm or more and 1 μm or less.

According to the invention, the fine resin particles preferably have a volume average particle size of 0.05 μm or more and 1 μm or less. The fine resin particles having the above volume average particle size can maintain its dispersibility and be handled with greater ease.

Further, in the invention, it is preferable that the adhesion aiding agent includes water or lower alcohol.

According to the invention, the adhesion aiding agent includes water or lower alcohol. This allows for enhancement in the wettability of the fine resin particles to the core particle, making it further easier to form the coating layer containing the fine resin particles and charge control agent over an entire surface or large surface part of the core particle. Moreover, it is possible to further shorten the length of drying time required for removing the adhesion aiding agent.

The invention provides a two-component developer containing the above-mentioned toner and a carrier.

According to the invention, the two-component developer preferably contains the toner having the effects as described above and the carrier. It is therefore possible to maintain stable chargeability.

The invention provides a developing device performing development with use of the above-mentioned two-component developer.

According to the invention, the two-component developer having the effects as described above is preferably used to perform development in the developing device. This allows for stable formation of toner images on the photoreceptor.

The invention provides an image forming apparatus having the above-mentioned developing device.

According to the invention, the image forming apparatus preferably has the developing device having the effects as described above. This allows for stable formation of images with good reproducibility.

BRIEF DESCRIPTION OF THE DRAWINGS

Other and further objects, features, and advantages of the invention will be more explicit from the following detailed description taken with reference to the drawings wherein.

DETAILED DESCRIPTION

Figure 1:
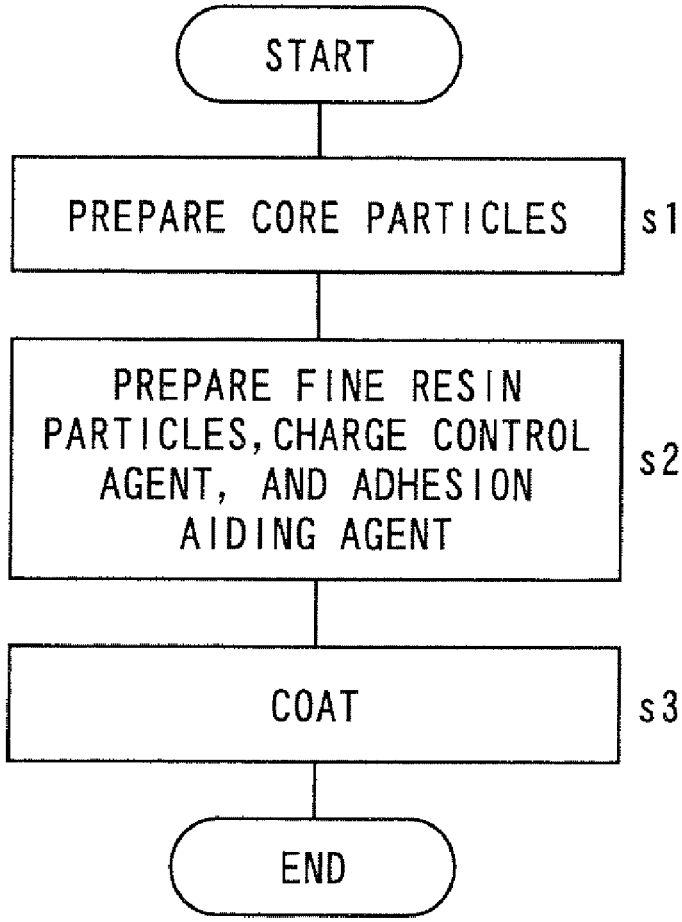
FIG. 1 is a flowchart showing a procedure in a method of manufacturing a toner according to one embodiment of the invention.

Now referring to the drawings, preferred embodiments of the invention are described below.

A toner of the invention includes a core particle containing binder resin and colorant, and a coating layer containing a fine resin particle and a charge control agent. The coating layer is formed on a surface of the core particle. At least a part of the fine resin particles contained in the coating layer are melt-bonded to the core particle, and the charge control agent is immobilized in the coating layer.

The coating layer containing the fine resin particles and the charge control agent is formed on the surface of the core particle containing the binder resin and the colorant, with the result that a toner surface layer has the charge control agent, which enhances the charge rising property of the toner. Moreover, at least a part of the fine resin particles are melt-bonded to the core particle, resulting in a toner in which the coating layer is firmly bonded to the core particle. The toner has the charge control agent immobilized in the coating layer and therefore is excellent in the environmental stability and life stability during printing, and causes less fogging.

The toner of the invention preferably has the charge control agent dispersed in the coating layer. The toner as just described is excellent in the charge rising property, environmental stability, and life stability during printing, and causes less fogging. When the toner is cut and a cross-section thereof is observed through a transmission electron microscope, it is possible to see what state the charge control agent is dispersed in.

The toner of the invention has a surface thereof covered with not only the resin but also the charge control agent in form of the coating layer, thereby allowing for enhancement in the charging properties (i.e., the charge rising property, the environmental stability, and the life stability). Moreover, at least a part of the resin is melt-bonded to the core particle, with the result that the coating layer can be prevented from falling off the core particle, for example, even when agitated inside a developing container. This enables the toner to be prevented from changing in properties in the long-term use.

The coating layer is formed on the surface of the core particle. In the case where the coating layer is formed on the surface of the core particle, the coating layer is formed preferably on a large part of the surface of the core particle. For example, it is preferred that a surface area of the core particle covered with the coating layer be 80% or more and 100% or less of the total surface area of the core particle (this figure may be referred to as "coverage"). This allows for enhancement in the charge rising property, the environmental stability, and the life stability during printing. If the coverage is less than 80%, the core particle has its larger surface area exposed, which delays the initial rise of charges and deteriorates the environmental stability. The coverage is more preferably 90% or more and 100% or less.

The coverage can be obtained as follows. For example, the toner is cut and a cross-section thereof is observed. In the cross-section of the toner, a boundary length and a length of covered part are measured by image analysis software. On the basis of a proportion of the boundary length to the length of covered part in the cross-section of the toner, the coverage is determined.

The total surface area of the core particle can be obtained as follows. Assuming that the core particles are all spherical, a volume average particle size of the core particles is calculated. And the surface area of the core particle covered with the coating layer can be obtained by using an image analyzer, etc., based on an image photographed by an electron microscope. These values of the surface areas may also be used to obtain the coverage. In the case where the coating layer is formed on a large part of the surface of the core particle, obtained effects will be the same as those obtained in the case where the coating layer is formed on the entire surface of the core particle, and therefore the following explanations will be based on the case where the coating layer is formed on the entire surface of the core particle.

The fine resin particles contained in the coating layer are partially melt-bonded to at least either of the core particle or adjacent fine resin particles. Since not all of the fine resin particles are molten, tiny protrusions are formed on a surface of the coating layer. It is preferable that at least a part of the fine resin particles contained in the coating layer be melt-bonded to at least a part of the adjacent fine resin particles. As a result, the fine resin particles are integrated with each other so that a solid coating layer is formed. Moreover, not only the fine resin particles but also the charge control agent is firmly melt-bonded to the core particle surface, with the result that the charge control agent is less likely to fall off, allowing for high charging stability during the whole life time of the toner. In addition, the tiny protrusions allow the toner to be more easily caught by a cleaning blade, thus enhancing the cleaning property. In the coating layer is formed on the entire surface of the core particle, the toner can be prevented from aggregating by appropriately selecting a material for the fine resin particles, thus being provided with excellent temporal stability.

The toner of the invention contains binder resin, colorant, a charge control agent, and other toner additive components. Examples of the other toner additive components include a release agent. Hereinafter, a method of manufacturing the toner of the invention will be explained. The toner of the invention is manufactured by, for example, fusing and bonding the fine resin particles and the charge control agent to the core particle with use of an adhesion aiding agent for increasing adhesion of the fine resin particles and charge control agent to the core particle.

FIG. 1 is a flowchart showing a procedure in a method of manufacturing a toner according to one embodiment of the invention. The method of manufacturing the toner according to the present embodiment includes Step s1 of preparing core particles, Step s2 of preparing fine resin particles, charge control agent, and adhesion aiding agent, and Step s3 of coating. Step s1 of preparing core particles and Step s2 of preparing fine resin particles, charge control agent, and adhesion aiding agent, may be conducted in reverse order in terms of time or may be conducted at the same time.

[Step of Preparing Core Particles]

In Step s1 of preparing core particles, the core particles containing the binder resin and the colorant are prepared. The core particles used for the toner of the invention contain the binder resin and the colorant and may further contain the release agent, the charge control agent, and the like component.

The binder resin is not particularly limited as long as it is customarily used as binder resin for toner, and includes, for example, polyester, polyurethane, epoxy resin, acrylic resin, and styrene-acrylic resin, among which polyester, acrylic resin, and styrene-acrylic resin are preferred. The resin may be used each alone, or two or more thereof may be used in combination. Further, a plurality of resin of the same kind different in any one or plural elements of their molecular weight, monomer composition, etc. may be used in combination.

Polyester is preferable as binder resin for color toner owing to its excellent transparency as well as good powder flowability, low-temperature fixing property, and secondary color reproducibility. For polyester, heretofore known substances may be used including a polycondensation or polybasic acid and polyvalent alcohol. For polybasic acid, substances known as monomers for polyester can be used including, for example: aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and methyl-esterified compounds of these polybasic acids. The polybasic acids may be used each alone, or two or more of them may be used in combination. For polyvalent alcohol, substances known as monomers for polyester can also be used including, for example: aliphatic polyvalent alcohols such as ethylene glycol, propylene glycol, butenediol, hexanediol, neopentyl glycol, and glycerin; alicyclic polyvalent alcohols such as cyclohexanediol, cyclohexanedimethanol, and hydrogenated bisphenol A; and aromatic diols such as ethylene oxide adduct of bisphenol A and propylene oxide adduct of bisphenol A. The polyvalent alcohols may be used each alone, or two or more of them may be used in combination. The polybasic acid and the polyvalent alcohol can undergo polycondensation reaction in an ordinary manner, that is, for example, the polybasic acid and the polyvalent alcohol are brought into contact with each other in the presence or absence of the organic solvent and in the presence of the polycondensation catalyst. The polycondensation reaction ends when an acid number, a softening temperature, etc. of the polyester to be produced reach predetermined values. The polyester is thus obtained. When the methyl-esterified compound of the polybasic acid is used as part of the polybasic acid, demethanol polycondensation reaction is caused. In the polycondensation reaction, a compounding ratio, a reaction rate, etc. of the polybasic acid and the polyvalent alcohol are appropriately modified, thereby being capable of, for example, adjusting a content of a carboxyl end group in the polyester and thus allowing for denaturation of the polyester. The denatured polyester can be obtained also by simply introducing a carboxyl group to a main chain of the polyester with use of trimellitic anhydride as polybasic acid. Note that polyester self-dispersible in water may also be used which polyester has a main chain or side chain bonded to a hydrophilic radical such as a carboxyl group or a sulfonate group. Further, polyester may be grafted with acrylic resin.

The acrylic resin is not particularly limited, and acid group-containing acrylic resin can be preferably used. The acid group-containing acrylic resin can be produced, for example, by polymerization of acrylic resin monomers or polymerization of an acrylic resin monomer and a vinylic monomer with concurrent use of an acidic group- or hydrophilic group-containing a acrylic resin monomer and/or acidic group- or hydrophilic group-containing a vinylic monomer. For acrylic resin monomer, heretofore known substances may be used including, for example, acrylic acid which may have a substituent, methacrylic acid which may have a substituent, acrylic acid ester which may have a substituent, and methacrylic acid ester which may have a substituent. Specific examples of the above acrylic resin monomers include: monomers of acrylic esters such as methyl acrylate, ethyl acrylate, isopropyl acrylate, n-butyl acrylate, isobutyl acrylate, n-amyl acrylate, isoamyl acrylate, n-hexyl acrylate, 2-ethylhexyl acrylate, n-octyl acrylate, decyl acrylate, and dodecyl acrylate; monomers of methacrylic esters such as methyl methacrylate, propyl methacrylate, n-butyl methacrylate, isobutyl methacrylate, n-amyl methacrylate, n-hexyl methacrylate, 2-ethylhexyl methacrylate, n-octyl methacrylate, decyl methacrylate, and dodecyl methacrylate; and hydroxyl group-containing monomers of (meth)acrylic esters such as hydroxyethyl acrylate and hydroxypropyl methacrylate. The acrylic resin monomers may be used each alone, or two or more of them may be used in combination. The vinylic resin monomer is not particularly limited, and may be a heretofore known substance including, for example, styrene, α-methylstyrene, vinyl bromide, vinyl chloride, vinyl acetate, acrylonitrile, and methacrylonitrile. The vinylic monomers may be used each alone, or two or more of them may be used in combination. The polymerization is effected by use of a commonly-used radical initiator in accordance with a solution polymerization method, a suspension polymerization method, an emulsification polymerization method, or the like method.

The styrene-acrylic resin is not particularly limited and includes, for example, a styrene-acrylic acid methyl copolymer, a styrene-acrylic acid ethyl copolymer, a styrene-acrylic acid butyl copolymer, a styrene-methacrylic acid methyl copolymer, a styrene-methacrylic acid ethyl copolymer, a styrene-methacrylic acid butyl copolymer, and a styrene-acrylonitrile copolymer.

It is preferred that the binder resin have a glass transition temperature of 30° C. or higher and 80° C. or lower. The binder resin having a glass transition temperature lower than 30° C. easily causes the blocking that the toner thermally aggregates inside the image forming apparatus, which may decrease preservation stability. The binder resin having a glass transition temperature higher than 80° C. lowers the fixing property of the toner onto a recording medium, which may cause a fixing failure.

As the colorant, it is possible to use an organic dye, an organic pigment, an inorganic dye, and an inorganic pigment, which are customarily used in the electrophotographic field.

Black colorant includes, for example, carbon black, copper oxide, manganese dioxide, aniline black, activated carbon, non-magnetic ferrite, magnetic ferrite, and magnetite.

Yellow colorant includes, for example, yellow lead, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tartrazine lake, C.I. pigment yellow 12, C.I. pigment yellow 13, C.I. pigment yellow 14, C.I. pigment yellow 15, C.I. pigment yellow 17, C.I. pigment yellow 93, C.I. pigment yellow 94, and C.I. pigment yellow 138.

Orange colorant includes, for example, red lead yellow, molybdenum orange, permanent orange GTR, pyrazolone orange, vulcan orange, indanthrene brilliant orange RK, benzidine orange G, indanthrene brilliant orange GK, C.I. pigment orange 31, and C.I. pigment orange 43.

Red colorant includes, for example, red iron oxide, cadmium red, red lead oxide, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. pigment red 2, C.I. pigment red 3, C.I. pigment red 5, C.I. pigment red 6, C.I. pigment red 7, C.I. pigment red 15, C.I. pigment red 16, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 149, C.I. pigment red 166, C.I. pigment red 177, C.I. pigment red 178, and C.I. pigment red 222.

Purple colorant includes, for example, manganese purple, fast violet B, and methyl violet lake.

Blue colorant includes, for example, Prussian bluer cobalt blue, alkali blue lake, Victoria blue lake, phthalocyanine blue, non-metal phthalocyanine blue, phthalocyanine blue-partial chlorination product, fast sky blue, indanthrene blue BC, C.I. pigment blue 15, C.I. pigment blue 15:2, C.I. pigment blue 15:3, C.I. pigment blue 16, and C.I. pigment blue 60.

Green colorant includes, for example, chromium green, chromium oxide, pigment green B, malachite green lake, final yellow green G, and C.I. pigment green 7.

White colorant includes, for example, those compounds such as zinc white, titanium oxide, antimony white, and zinc sulfide.

The colorants may be used each alone, or two or more of the colorants of different colors may be used in combination. Further, two or more of the colorants with the same color may be used in combination. A usage of the colorant is not limited to a particular amount, and preferably 0.1 part by weight to 20 parts by weight and more preferably 0.2 part by weight to 10 parts by weight based on 100 parts by weight of the binder resin.

As the release agent, it is possible to use ingredients which are customarily used in the relevant field, including, for example, petroleum wax such as paraffin wax and derivatives thereof, and microcrystalline wax and derivatives thereof; hydrocarbon-based synthetic wax such as Fischer-Tropsch wax and derivatives thereof, polyolefin wax (e.g. polyethylene wax and polypropylene wax) and derivatives thereof, low-molecular-weight polypropylene wax and derivatives thereof, and polyolefinic polymer wax (low-molecular-weight polyethylene wax, etc.) and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amides and phenolic fatty acid esters; long-chain carboxylic acids and derivatives thereof; long-chain alcohols and derivatives thereof; silicone polymers; and higher fatty acids. Note that examples of the derivatives include oxides, block copolymers of a vinylic monomer and wax, and graft-modified derivatives of a vinylic monomer and wax. A usage of the wax may be appropriately selected from a wide range without particularly limitation, and preferably 0.2 part by weight to 20 parts by weight, more preferably 0.5 part by weight to 10 parts by weight, and particularly preferably 1.0 part by weight to 8.0 parts by weight based on 100 parts by weight of the binder resin.

The usable charge control agent includes a positive charge control agent and a negative charge control agent which are customarily used in the relevant field. The positive charge control agent includes, for example, a basic dye, quaternary ammonium salt, quaternary phosphonium salt, aminopyrine, a pyrimidine compound, a polynuclear polyamino compound, aminosilane, a nigrosine dye, a derivative thereof, a triphenylmethane derivative, guanidine salt, and amidine salt. The negative charge control agent includes oil-soluble dyes such as oil black and spiron black, a metal-containing azo compound, an azo complex dye, metal salt naphthenate, salicylic acid, metal complex or metal salt (the metal includes chrome, zinc, and zirconium) of a salicylic acid derivative, a fatty acid soap, long-chain alkylcarboxylic acid salt, and a resin acid soap. The above charge control agents may be used each alone and according to need, two or more of them may be used in combination. A usage of the charge control agent is not limited to a particular level and may be selected as appropriate from a wide range. In the case where the charge control agent is contained in the core particles, a preferable usage of the charge control agent is 0.5 part by weight to 3 parts by weight based on 100 parts by weight of the binder resin.

The core particles can be manufactured in accordance with a commonly-used method of manufacturing a toner. The commonly-used method of manufacturing a toner includes dry processes such as a pulverization method; and wet processes such as a suspension polymerization method, an emulsification aggregation method, a dispersion polymerization method, a dissolution suspension method, and a melting emulsification method. There will be hereinbelow described a method of preparing the core particles which employs the pulverization method.

In the pulverization method, a toner composition containing the binder resin, the colorant, and the other toner additive component is dry-mixed by a mixer and thereafter melt-kneaded by a kneader. A kneaded material thus obtained through the melt-kneading process is cooled and solidified into a solidified material which is then pulverized by a pulverizer. A resultant material is subsequently treated with particle size adjustment such as classification according to need. The core particles are thus obtained.

Usable mixers include heretofore known mixers including, for example, Henschel-type mixing devices such as HENSCHELMIXER (trade name) manufactured by Mitsui Mining Co., SUPERMIXER (trade name) manufactured by Kawata MFG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd.

Usable kneaders include heretofore known kneaders including, for example, commonly-used kneaders such as a twin-screw extruder, a three roll mill, and a laboplast mill. Specific examples of such kneaders include single or twin screw extruders such as TEM-100B (trade name) manufactured by Toshiba Machine Co., Ltd., PCM-65/87 and PCM-30, both of which are trade names and manufactured by Ikegai, Ltd., and open roll-type kneading machines such as KNEADEX (trade name) manufactured by Mitsui Mining Co., Ltd.

An additive for synthetic resin, such as colorant, may be formed into a master batch so as to be dispersed evenly into the kneaded material. Moreover, two or more additives for synthetic resin may be formed into a particulate composite. The particulate composite can be manufactured, for example, in a manner that an appropriate amount of water, lower alcohol, or the like material is added to two or more additives for synthetic resin which are then granulated through a commonly-used granulator such as a high-speed mill, followed by being dried. The master batch and the particulate composite are mixed with a powder mixture during a dry-mixing operation.

The core particles preferably have an average particle size of preferably 3 μm or more and 10 μm or less, and more preferably 5 μm or more and 8 μm or less. With the toner having the core particles whose average particle size is 3 μm or more and 10 μm or less, high-resolution images can be formed stably for a long period of time. In the case where the average particle size of the core particles is less than 3 μm, the particle size of the core particle is too small, which may cause the toner to be excessively charged and have low fluidity. The excessively-charged toner having the low fluidity cannot be stably supplied to the photoreceptor, thus causing background fog and a decrease in image density. In the case where the average particle size of the core particles exceeds 10 μm, the particle size of the core particle is so large that high-resolution images cannot be obtained. Further, the larger particle size of the core particle leads to a decrease in a specific surface area thereof, resulting in a toner less charged. The toner less charged cannot be stably supplied to the photoreceptor and may spatter inside the apparatus to cause internal contamination.

[Step of Preparing Fine Resin Particles, Charge Control Agent, and Adhesion Aiding Agent]

In Step s2 of preparing fine resin particles, charge control agent, and adhesion aiding agent, the fine resin particles containing at least resin are prepared as well as the charge control agent, and moreover the adhesion aiding agent is also prepared which increases adhesion of the fine resin particles and charge control agent to the core particles.

Resin usable for the fine resin particles is not particularly limited and thus includes, for example, polyester, acrylic resin, styrene-acrylic copolymer resin, and styrene resin. It is preferred that the fine resin particles contain acrylic resin, styrene-acrylic copolymer resin, or polyester, among those resin cited above. The acrylic resin, styrene-acrylic copolymer resin, or polyester has many advantages such as being lightweight, strong, high in transparency, and inexpensive.

The resin contained in the fine resin particles may be of the same sort as that of the binder resin contained in the core particles. Resin different from the binder resin contained in the core particles is also applicable for the fine resin particles, and from the perspective of treating the toner with surface modification, the use of different resin is preferred. In the case of using such different resin for the fine resin particles, it is preferable to select resin whose softening temperature is higher than that of the binder resin contained in the core particles. By so doing, the toner stored is prevented from having its particles being melt-bonded to each other, allowing for enhancement in preservation stability. The softening temperature of the resin contained in the fine resin particles is preferably 80° C. or more and 140° C. or less although it depends on an image forming apparatus where the toner is used. The use of the resin having a temperature in the above range will result in a toner which exhibits good preservation stability and fixing performance.

The fine resin particles as described above can be obtained, for example, in a manner that raw materials of the fine resin particles are emulsified and dispersed into fine grains by using a homogenizer or the like machine. Further, the fine resin particles can also be obtained by polymerizing monomers.

The volume average particle size of fine resin particles before fusion needs to be smaller enough than the average particle size of the core particles. Furthermore, the volume average particle size of fine resin particles before fusion is preferably 0.05 μm or more and 1 μm or less, and more preferably 0.1 μm or more and 0.5 μm or less. This makes it easier to handle the fine resin particles with dispersibility thereof maintained.

The fine resin particles before fusion having a volume average particle size less than 0.05 μm are too small and therefore, it becomes harder to handle the fine resin particles. In the case of spraying the fine resin particle dispersion containing the fine resin particles, charge control agent, and the adhesion aiding agent from one atomizing nozzle in the later-described step of coating, the fine resin particles may be less dispersive into the fine resin particle dispersion.

The fine resin particles before fusion having a volume average particle size over 1 μm form a thicker coating layer, thus increasing a proportion of the coating layer in the toner. When the proportion of the coating layer in the toner is large, the coating layer is so influential in forming images that desired images may not be formed, through it depends on a material forming the coating layer.

The usable charge control agent includes a positive charge control agent and a negative charge control agent which are customarily used in the relevant field. The positive charge control agent includes, for example, a basic dye, quaternary ammonium salt, quaternary phosphonium salt, aminopyrine, a pyrimidine compound, a polynuclear polyamino compound, aminosilane, a nigrosine dye, a derivative thereof, a triphenylmethane derivative, guanidine salt, and amidine salt. The negative charge control agent includes oil-soluble dyes such as oil black and spiron black, a metal-containing azo compound, an azo complex dye, metal salt naphthenate, salicylic acid, metal complex or metal salt (the metal includes chrome, zinc, zirconium, and aluminum) of a salicylic acid derivative, a fatty acid soap, long-chain alkylcarboxylic acid salt, a resin acid soap, bisdiphenylglycolic acid, metal complex or metal salt (the metal is boron) of a bisdiphenylglycolic acid derivative, and other commercially-available charge control resin (abbreviated as CCR). The above charge control agents may be used each alone and according to need, two or more of them may be used in combination. A usage of the charge control agent is not limited to a particular amount and may be selected as appropriate from a wide range.

Among the above substances, at least one or more of a salicylic acid compound, a bisdiphenylglycolic acid compound, and charge control resin is preferably selected in particular. These charge control agents have high transparency and are therefore capable of forming clearer images.

A content of the charge control agent is preferably 1 part by weight or more and 100 parts by weight or less based on 100 parts by weight of the fine resin particles. This enhances the charge rising property, the environmental stability, and the life stability during printing.

A dispersion diameter of the charge control agent immobilized is less than 1 μm. As a result, the charge control agent becomes less likely to aggregate and thereby able to be uniformly dispersed in the surfaces of the core particles. Moreover, the change control agent is prevented from falling off the core particles, therefore leading to enhancement in the charge rising property, the environmental stability, and the life stability during printing. The dispersed charge control agent, which has a dispersion diameter of 1 μm or more, will easily fall off the core particles.

The charge control agent soluble in the adhesion aiding agent may be used, and such a charge control agent can be dispersed more uniformly in the surface of the toner.

In Step s2 of preparing fine resin particles, charge control agent, and adhesion aiding agent, the adhesion aiding agent is prepared which increases adhesion of the charge control agent and fine resin particles to the core particle. The adhesion aiding agent indicates a liquid which can enhance the wettability of the fine resin particles to the core particle. The adhesion aiding agent is preferably a liquid which does not dissolve the core particle. Moreover, the adhesion aiding agent is preferably a volatile liquid because it has to be removed after the fine resin particles are coated.

The adhesion aiding agent as described above preferably includes water or lower alcohol, for example. This allows for enhancement in the wettability of the fine resin particles to the core particle, making it further easier to form the coating layer containing the fine resin particles and charge control agent over an entire surface or large surface part of the core particle. Moreover, it is possible to further shorten the length of drying time required for removing the adhesion aiding agent. Examples of the lower alcohol include methanol, ethanol, and propanol.

The adhesion aiding agent is not limited to those materials cited above and thus includes, for example, alcohols such as butanol, diethylene glycol, and grycerin; ketones such as acetone and methyl ethyl ketone; and esters such as methyl acetate and ethyl acetate.

[Step of Coating]

In Step s3 of coating, the fine resin particles and charge control agent are attached and melt-bonded to the core particle with use of the adhesion aiding agent which increases the adhesion of the fine resin particles and charge control agent to the core particle. By so doing, the core particle is coated with the fine resin particles and charge control agent which form the coating layer. The use of the adhesion aiding agent for increasing the adhesion of the fine resin particles and charge control agent to the core particle enhances the wettability of the fine resin particles to the core particle, thereby making it easy to form the coating layer containing the fine resin particles over the entire surface or large surface part of the core particle. The coating layer thus formed is less likely to fall off the core particle owing to the fine resin particles which are melt-bonded to the core particle. Moreover, the charge control agent can be dispersed into such a coating layer firmly attached to the core particle, and therefore are also less likely to fall off the core particle. Accordingly, the coating layer is prevented from falling off in the long-term use so that the toner is prevented from changing in properties, resulting in enhancement in the charge rising property, the environmental stability, and the life stability during printing.

The step of coating is implemented by using a surface-modifying device, for example. The surface-modifying device includes: a container for storing the core particles, fine resin particles, and the charge control agent; and an atomizer for atomizing the adhesion aiding agent into the container. In the present embodiment, the surface-modifying device further includes an agitator for agitating the core particles inside the container.

A container of closable type may be used as the container for storing the core particles, the fine resin particles, and the charge control agent. The atomizer has an adhesion aiding agent reservoir for storing the adhesion aiding agent; a carrier gas reservoir for storing carrier gas; and a liquid-atomizing unit for atomizing the adhesion aiding agent into droplets which are given to the core particles contained inside the container by spraying a mixture of the adhesion aiding agent and the carrier gas to the core particles. The carrier gas may be compressed air or the like gas. The liquid-atomizing unit is available in the market, including such a device that a binary fluid nozzle: AM-6 (trade name) manufactured by ATMAX INC. is connected to a tube pump: MP-1000A (trade name) manufactured by Tokyo Rikakikai Co., Ltd. through which a metered quantity of the adhesion aiding agent can be supplied. The agitator may be an agitator rotor which can provide the core particles with mechanical and thermal energy based on impact force.

The container provided with the agitator is available in the market, including, for example, Henschel-type mixing devices such as HENSCHELMIXER (trade name) manufactured by Mitsui Mining Co., Ltd., SUPERMIXER (trade name) manufactured by Kawata MFG Co., Ltd., and MECHANOMILL (trade name) manufactured by Okada Seiko Co., Ltd., ANGMILL (trade name) manufactured by Hosokawa Micron Corporation, HYBRIDIZATION SYSTEM (trade name) manufactured by Nara Machinery Co., Ltd., and COSMOSYSTEM (trade name) manufactured by Kawasaki Heavy Industries, Ltd. The liquid-atomizing unit is installed in a container having the above-cited mixer, which can be then used as the surface-modifying device according to the present embodiment.

The coating of the fine resin particles and charge control agent is performed on the core particles as follows. At the outset, the core particles, the fine resin particles, and the charge control agent are put in the container and agitated therein by the agitator while the adhesion aiding agent is atomized into the container. To the core particles and the fine resin particles, the atomized adhesion aiding agent is given and the thermal energy is added by agitation so that the surfaces of the core particles and the fine resin particles are swollen and softened. In addition, the mechanical impact force generated by the agitator is also applied to the core particles and the fine resin particles so that the fine resin particles are firmly adhered to the surfaces of the core particles and simultaneously, a part of the fine resin particles is melt-bonded to at least either of the core particles or the adjacent fine resin particles. At this time, the charge control agent is caught in the fine resin particles and thus bonded to the surfaces of the core particles with also the fine resin particles being bonded thereto. This enables the fine resin particles containing the charge control agent to be attached to the entire surfaces of the core particles, allowing for formation of the resin coating layer having the charge control agent immobilized in the entire surfaces of the core particles.

In the manner as just described, the charge control agent and the fine resin particles can be attached to the core particle with use of the adhesion aiding agent. When the surface-modifying device as described above is used, it is easy to set the use ratio between the core particles and the fine resin particles, thereby allowing the coating layer to have a favorable thickness.

A temperature inside the container of the surface-modifying device is preferably less than a glass transition temperature of the binder resin contained in the core particles. When the temperature inside the container is equal to or higher than the glass transition temperature of the binder resin contained in the core particles, the core particles may be excessively fused to aggregate inside the container in manufacturing the toner. It is therefore preferable to cool down, as needed, the inside of the surface-modifying device so as to prevent the core particles from aggregating.

Furthermore, it is preferred that the adhesion aiding agent be atomized in the state where the core particles are suspended in the air inside the container. In the case where the mixture of the fine resin particles and the adhesion aiding agent is atomized in the state where the core particles are suspended in the air inside the container, the core particles coated with the atomized adhesion aiding agent are in contact with each other in a shorter length of time. This enables to prevent the toner aggregation so as not to generate coarse particles in manufacturing the toner, thus allowing for a toner made of particles uniform in size. The core particles can be suspended in the air inside the container, for example, by agitation of the agitator or the air supply.

A use ratio of the fine resin particles is not limited to a particular level, but needs to be such a ratio as to coat the entire surfaces of the core particles. The use ratio of the fine resin particles is preferably 1 part by weight to 30 parts by weight based on 100 parts by weight of the core particles. The use of the fine resin particles less than 1 part by weight may cause a failure to coat the entire surfaces of the core particles with the coating layers. The use of the fine resin particles exceeding 30 parts by weight may cause the coating layer to be too large in thickness, possibly leading to deterioration of the fixing property of the toner, depending on a material constituting the fine resin particles.

A usage of the adhesion aiding agent is not limited to a particular amount, and preferable is such an amount as to have the entire surfaces of the core particles wet. The usage of the adhesion aiding agent is determined based on the usage of the core particles. Further, the amount of the adhesion aiding agent can be adjusted by changing a length of time, a frequency, etc. of the atomization effected by the atomizer. For such an adjustment, it is only necessary to terminate the atomization of adhesion aiding agent effected by the atomizer, for example, at the moment when most of the fine resin particles present in the container are attached to the core particles, after setting the average particle size of the core particles, the use ratio of the core particles and the fine resin particles, and a per-hour atomization amount of the atomizer depending on a material of the core particles, a material of the fine resin particles, and the like element.

The core particles may be coated with the fine resin particles by a surface-modifying device which includes: a container for storing the core particles; and an atomizer for atomizing the mixture of the fine resin particles, the charge control agent, and the adhesion aiding agent into the container. The surface-modifying device as just stated may be the same as the device mentioned above except that the mixture of the adhesion aiding agent, the fine resin particles, and the charge control agent is stored in the adhesion aiding agent reservoir.

The above surface-modifying device performs the coating of the fine resin particles and the charge control agent on the core particles as follows. At the outset, the core particles are put in the container and agitated therein by the agitator while the mixture of the fine resin particles, the charge control agent, and the adhesion aiding agent is atomized into the container. To the core particles, the atomized adhesion aiding agent is given and the thermal energy is added by agitation so that the surfaces of the core particles are swollen and softened. The fine resin particles which are mixed with the adhesion aiding agent are also atomized into the container and then given the thermal energy through agitation so that the surfaces of the fine resin particles are swollen and softened as well as the core particles. In addition, the mechanical impact force generated by the agitator is also applied so that the fine resin particles are bonded to the surfaces of the core particles and simultaneously, a part of the fine resin particles are melt-bonded to at least either of the core particles or the adjacent fine resin particles. At this time, the charge control agent is caught in the fine resin particles and thus bonded to the surfaces of the core particles with also the fine resin particles being bonded thereto. This enables the fine resin particles to be attached to the entire surfaces of the core particles, allowing for formation of the resin coating layer having the charge control agent immobilized in the entire surfaces of the core particles.

Also in the manner as just described, the fine resin particles can be attached to the core particle with use of the adhesion aiding agent and moreover, and it is easy to melt-bond uniform amounts of the fine resin particles and the charge control agent to the core particle.

In the case where the mixture of the adhesion aiding agent, the fine resin particles, and the charge control agent is atomized, a preferable usage of the adhesion aiding agent is 1 part by weight or more and 99 parts by weight or less based on 1 part by weight of the fine resin particles. The mixture of the adhesion aiding agent and the fine resin particles, namely, a coating solution, has been prepared in advance in Step s2 of preparing the fine resin particles, charge control agent, and the adhesion aiding agent. In the case where the mixture of the fine resin particles, the charge control agent, and the adhesion aiding agent is atomized by one atomizer, the use of the mixture containing the fine resin particles and the adhesion aiding agent in the above ratio can sufficiently enhance the wettability of the fine resin particles to the core particles and moreover shorten the length of time required to remove the adhesion aiding agent. Further, in this case, the mixture has such favorable viscosity as to be easily atomized by the atomizer. The mixture containing the adhesion aiding agent less than 1 part by weight is too viscous, with which nozzle holes of the atomizing unit may be clogged. When the usage of the adhesion aiding agent exceeds 99 parts by weight, a content of the adhesion aiding agent is too large, requiring an excessively long time for removing the adhesion aiding agent.

The core particles may be coated with the fine resin particles by a surface-modifying device which includes: a container for storing the core particles and the fine resin particles; and an atomizer for atomizing the mixture of the charge control agent and the adhesion aiding agent into the container. The surface-modifying device as just stated may be the same as the device mentioned above except that the mixture of the adhesion aiding agent and the charge control agent is stored in the adhesion aiding agent reservoir.

The above surface-modifying device performs the coating of the fine resin particles and the charge control agent on the core particles as follows. At the outset, the core particles and the fine resin particles are put in the container and agitated therein by the agitator while the mixture of the adhering agent and the charge control agent is atomized into the container. To the core particles and the fine resin particles, the atomized adhesion aiding agent containing the charge control agent is given and the thermal energy is added by agitation so that the surfaces of the core particles and the fine resin particles are swollen and softened. And the fine resin particles are adhered to the surfaces of the core particles and simultaneously, part of the fine resin particles are melt-bonded to at least either of the core particles or the adjacent fine resin particles to form a coating layer. At this time, the charge control agent is caught in the fine resin particles and thus bonded to the surfaces of the core particles with also the fine resin particles being bonded thereto. This enables the fine resin particles to be attached to the entire surfaces of the core particles, allowing for formation of the resin coating layer having the charge control agent immobilized in the entire surfaces of the core particles.

In the manner as just described, the charge control agent can be uniformly attached to the outermost surfaces. When the surface-modifying device as described above is used, it is easy to set the use ratio between the core particles and the fine resin particles, allowing the coating layer to have a favorable thickness.

A usage of the mixture of the charge control agent and the adhesion aiding agent is not limited to a particular amount, but needs to be such that an amount of the contained fine resin particles is large enough to coat the entire surfaces of the core particles. Since a preferable amount of the fine resin particles for coating the entire surfaces of the core particles is 1 part by weight or more and 30 parts by weight or less based on 100 parts by weight of the core particles as in the above case, the usage of the mixture is determined in accordance with the content of the fine resin particles in the mixture.

After the entire surfaces of the core particles have been coated with the fine resin particles and the charge control agent, the adhesion aiding agent is removed. The removal of the adhesion aiding agent is carried out by using a drier or the like machine to gasify the adhesion aiding agent. The drier for use in removal of the adhesion aiding agent may be a commonly-used drier such as a hot-air heat-receiving drier, a conductive drier, or a freeze drier.

As described above, the toner of the invention is obtained that includes the core particle containing the binder resin and colorant, and the coating layer containing the resin and charge control agent, which layer is formed on the surface of the core particle, with the fine resin particles contained in the coating layer having at least a part thereof melt-bonded to the core particle, and the charge control agent being immobilized in the coating layer. In the toner as just described, the coating layer containing the fine resin particles and the charge control agent is formed on the surface of the core particle containing the binder resin and the colorant, with the result that a toner surface layer has the charge control agent, which enhances the charge rising property of the toner, the environmental stability, and the life stability during printing. Moreover, at least a part of the fine resin particles is melt-bonded to the core particle, resulting in a toner in which the coating layer is firmly bonded to the core particle. The toner has the charge control agent immobilized in the coating layer and therefore is excellent in the charge rising property, the environmental stability, and the life stability during printing, and causes less fogging.

To the toner of the invention, an external additive may be added. As the external additive, heretofore known substances can be used including silica and titanium oxide. It is preferred that these substances be surface-treated with silicone resin and a silane coupling agent. A preferable usage of the external additive is 1 part by weight to 10 parts by weight based on 100 parts by weight of the toner.

The toner of the invention can be used in form of either one-component developer or two-component developer. In the case where the toner is used in form of one-component developer, only the toner is used without carriers while a blade and a fur brush are used to effect the fictional electrification at a developing sleeve so that the toner is attached onto the sleeve, thereby conveying the toner to perform image formation. Further, in the case where the toner is used in form of two-component developer, the toner of the invention is used together with a carrier. As the carrier, heretofore known substances can be used including, for example, single or complex ferrite composed of iron, copper, zinc, nickel, cobalt, manganese, and chromium; a resin-coated carrier having carrier core particles whose surfaces are coated with coating substances; or a resin-dispersion carrier in which magnetic particles are dispersed in resin. As the coating substance, heretofore known substances can be used including polytetrafluoroethylene, a monochloro-trifluoroethylene polymer, polyvinylidene-fluoride, silicone resin, polyester, a metal compound of di-tertiary-butylsalicylic acid, styrene resin, acrylic resin, polyamide, polyvinyl butyral nigrosine, aminoacrylate resin, basic dyes or lakes thereof, fine silica powder, and fine alumina powder. In addition, the resin used for the resin-dispersion carrier is not limited to particular resin, and examples thereof include styrene-acrylic resin, polyester resin, fluorine resin, and phenol resin. Both of the coating substance in the resin-coated carrier and the resin used for the resin-dispersion carrier are preferably selected according to the toner components. Those substances and resin listed above may be used each alone, and two or more thereof may be used in combination.

A particle of the carrier preferably has a spherical shape or flattened shape. A particle size of the carrier is not limited to a particular diameter, and in consideration of forming higher-quality images, the particle size of the carrier is preferably 10 μm to 100 μm and more preferably 20 μm to 50 μm. Further, the resistivity of the carrier is preferably $10^8$ Ω·cm or more, and more preferably $10^{12}$ Ω·cm or more. The resistivity of the carrier is obtained as follows. At the outset, the carrier is put in a container having a cross section of 0.50 $cm^2$, thereafter being tapped. Subsequently, a load of 1 $kg/cm^2$ is applied by use of a weight to the carrier particles which are held in the container as just stated. When an electric field of 1,000 V/cm is generated between the weight and a bottom electrode of the container by application of voltage, a current value is read. The current value indicates the resistivity of the carrier. When the resistivity of the carrier is low, electric charges will be injected into the carrier upon application of bias voltage to a developing sleeve, thus causing the carrier particles to be more easily attached to the photoreceptor. In this case, the breakdown of bias voltage is more liable to occur.

Magnetization intensity (maximum magnetization) of the carrier is preferably 10 emu/g to 60 emu/g and more preferably 15 emu/g to 40 emu/g. The magnetization intensity depends on magnetic flux density of a developing roller. Under the condition of ordinary magnetic flux density of the developing roller, however, no magnetic binding force work on the carrier having the magnetization intensity less than 10 emu/g, which may cause the carrier to spatter. The carrier having the magnetization intensity larger than 60 emu/g has bushes which are too large to keep the non-contact state with the image bearing member in the non-contact development or to possibly cause sweeping streaks to appear on a toner image in the contact development.

A use ratio of the toner to the carrier in the two-component developer is not limited to a particular ratio, and the use ratio is appropriately selected according to kinds of the toner and carrier. To take the resin-coated carrier (having density of 5 $g/cm^2$ to 8 $g/cm^2$) as an example, the usage of the toner may be determined such that a content of the toner in the developer is 2% by weight to 30% by weight and preferably 2% by weight to 20% by weight of the total amount of the developer. Further, in the two-component developer, coverage of the carrier with the toner is preferably 40% to 80%.

Figure 2:
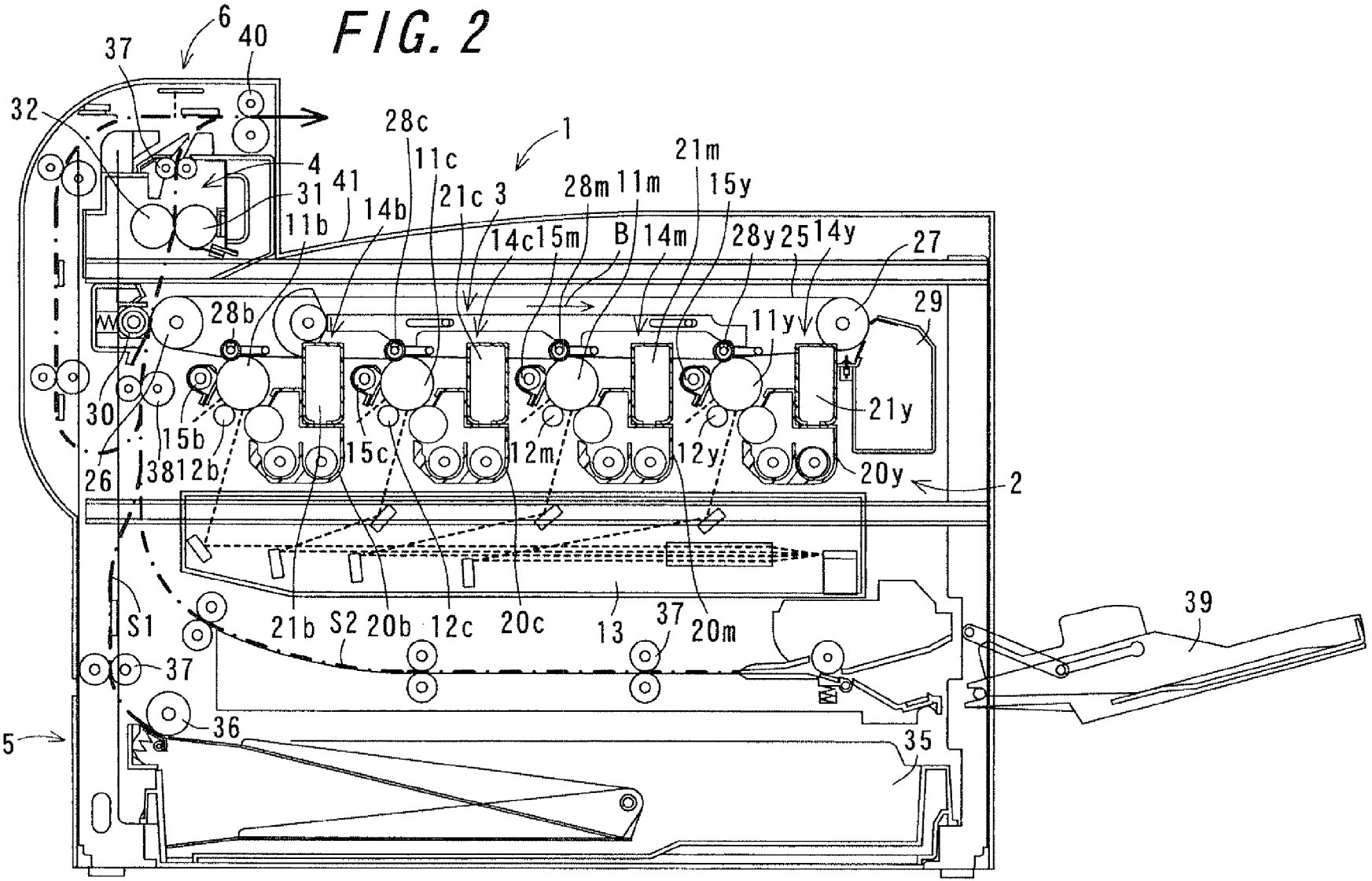
FIG. 2 is a sectional view schematically showing a configuration of an image forming apparatus according to the invention.

FIG. 2 is a sectional view schematically showing a configuration of an image forming apparatus 1 according to the invention. The image forming apparatus 1 is a multifunctional system which combines a copier function, a printer function, and a facsimile function. In the image forming apparatus 1, according to image information transmitted thereto, a full-color or black-and-white image is formed on a recording medium. To be specific, three print modes, i.e., a copier mode, a printer mode, and a facsimile mode are available in the image forming apparatus 1, one of which print modes is selected by a control unit (not shown) in response to an operation input given by an operating section (not shown) or a print job given by a personal computer, a mobile computer, an information record storage medium, or an external equipment having a memory unit. The image forming apparatus 1 includes a toner image forming section 2, a transferring section 3, a fixing section 4, a recording medium feeding section 5, and a discharging section 6. In accordance with image information of respective colors of black (b), cyan (c), magenta (m), and yellow (y) which are contained in color image information, there are provided respectively four sets of the components constituting the toner image forming section 2 and some parts of the components contained in the transfer section 3. The four sets of respective components provided for the respective colors are distinguished herein by giving alphabets indicating the respective colors to the end of the reference numerals, and in the case where the sets are collectively referred to, only the reference numerals are shown.

The toner image forming section 2 includes a photoreceptor drum 11, a charging section 12, an exposure unit 13, a developing device 14, and a cleaning unit 15. The charging section 12, the developing device 14, and the cleaning unit 15 are disposed in the order just stated around the photoreceptor drum 11. The charging section 12 is disposed vertically below the developing device 14 and the cleaning unit 15.

The photoreceptor drum 11 is rotatably supported around an axis thereof by a drive mechanism (not shown), and includes a conductive substrate and a photosensitive layer formed on a surface of the conductive substrate (not shown). The conductive substrate may be formed into various shapes such as a cylindrical shape, a circular columnar shape, and a thin film sheet shape. Among these shapes, the cylindrical shape is preferred. The conductive substrate is formed of a conductive material. As the conductive material, those customarily used in the relevant field can be used including, for example, metals such as aluminum, copper, brass, zinc, nickel, stainless steel, chromium, molybdenum, vanadium, indium, titanium, gold, and platinum; alloys formed of two or more of the metals; a conductive film in which a conductive layer containing one or two or more of aluminum, aluminum alloy, tin oxide, gold, indium oxide, etc. Is formed on a film-like substrate such as a synthetic resin film, a metal film, and paper; and a resin composition containing conductive particles and/or conductive polymers. As the film-like substrate used for the conductive film, a synthetic resin film is preferred and a polyester film is particularly preferred. Further, as the method of forming the conductive layer in the conductive film, vapor deposition, coating, etc. are preferred.

The photosensitive layer is formed, for example, by stacking a charge generating layer containing a charge generating substance, and a charge transporting layer containing a charge transporting substance. In this case, an undercoat layer is preferably formed between the conductive substrate and the charge generating layer or the charge transporting layer. When the undercoat layer is provided, the flaws and irregularities present on the surface of the conductive substrate are covered, leading to advantages such that the photosensitive layer has a smooth surface, that chargeability of the photosensitive layer can be prevented from degrading during repetitive use, and that the chargeability of the photosensitive layer can be enhanced under at least either a low temperature circumstance or a low humidity circumstance. Further, a laminated photoreceptor is also applicable which has a highly-durable three-layer structure having a photoreceptor surface-protecting layer provided on the top layer.

The charge generating layer contains as a main substance a charge generating substance that generates charges under irradiation of light, and optionally contains known binder resin, plasticizer, sensitizer, etc. As the charge generating substance, materials used customarily in the relevant field can be used including, for example, perylene pigments such as perylene imide and perylenic acid anhydride; polycyclic quinone pigments such as quinacridone and anthraquinone; phthalocyanine pigments such as metal and non-metal phthalocyanines, and halogenated non-metal phthalocyanines; squalium dyes; azulenium dyes; thiapylirium dyes; and azo pigments having carbazole skeleton, styrylstilbene skeleton, triphenylamine skeleton, dibenzothiophene skeleton, oxadiazole skeleton, fluorenone skeleton, bisstilbene skeleton, distyryloxadiazole skeleton, or distyryl carbazole skeleton. Among those charge generating substances, non-metal phthalocyanine pigments, oxotitanyl phthalocyanine pigments, bisazo pigments containing fluorene rings and/or fluorenone rings, bisazo pigments containing aromatic amines, and trisazo pigments have high charge generating ability and are suitable for forming a highly-sensitive photosensitive layer. The charge generating substances may be used each alone, or two or more of them may be used in combination. The content of the charge generating substance is not particularly limited, and preferably from 5 parts by weight to 500 parts by weight and more preferably from 10 parts by weight to 200 parts by weight based on 100 parts by weight of the binder resin in the charge generating layer. Also as the binder resin for charge generating layer, materials used customarily in the relevant field can be used including, for example, melamine resin, epoxy resin, silicone resin, polyurethane, acrylic resin, vinyl chloride-vinyl acetate copolymer resin, polycarbonate, phenoxy resin, polyvinyl butyral, polyallylate, polyamide, and polyester. The binder resin may be used each alone or optionally two or more of them may be used in combination.

The charge generating layer can be formed by dissolving or dispersing an appropriate amount of a charge generating substance, binder resin and, optionally, a plasticizer, a sensitizer, etc. respectively in an appropriate organic solvent which is capable of dissolving or dispersing the substances described above, to thereby prepare a coating solution for charge generating layer, and then applying the coating solution for charge generating layer to the surface of the conductive substrate, followed by drying. The thickness of the charge generating layer obtained in this way is not particularly limited, and preferably from 0.05 μm to 5 μm and more preferably from 0.1 μm to 2.5 μm.

The charge transporting layer stacked over the charge generating layer contains as essential substances a charge transporting substance having an ability of receiving and transporting charges generated from the charge generating substance, and binder resin for charge transporting layer, and optionally contains known antioxidant, plasticizer, sensitizer, lubricant, etc. As the charge transporting substance, materials used customarily in the relevant field can be used including, for example: electron donating materials such as poly-N-vinyl carbazole, a derivative thereof, poly-γ-carbazolyl ethyl glutamate, a derivative thereof, a pyrene-formaldehyde condensation product, a derivative thereof, polyvinylpyrene, polyvinyl phenanthrene, an oxazole derivative, an oxadiazole derivative, an imidazole derivative, 9-(p-diethylaminostyryl) anthracene, 1,1-bis(4-dibenzylaminophenyl)propane, styrylanthracene, styrylpyrazoline, a pyrazoline derivative, phenyl hydrazones, a hydrazone derivative, a triphenylamine compound, a tetraphenyldiamine compound, a triphenylmethane compound, a stilbene compound, and an azine compound having 3-methyl-2-benzothiazoline ring; and electron accepting materials such as a fluorenone derivative, a dibenzothiophene derivative, an indenothiophene derivative, a phenanthrenequinone derivative, an indenopyridine derivative, a thioquisantone derivative, a benzo[c]cinnoline derivative, a phenazine oxide derivative, tetracyanoethylene, tetracyanoquinodimethane, bromanil, chloranil, and benzoquinone. The charge transporting substances may be used each alone, or two or more of them may be used in combination. The content of the charge transporting substance is not particularly limited, and preferably from 10 parts by weight to 300 parts by weight and more preferably from 30 parts by weight to 150 parts by weight based on 100 parts by weight of the binder resin in the charge transporting layer. As the binder resin for charge transporting layer, it is possible to use materials which are used customarily in the relevant field and capable of uniformly dispersing the charge transporting substance, including, for example, polycarbonate, polyallylate, polyvinylbutyral, polyamide, polyester, polyketone, epoxy resin, polyurethane, polyvinylketone, polystyrene, polyacrylamide, phenolic resin, phenoxy resin, polysulfone resin, and copolymer resin thereof. Among those materials, in view of the film forming property, and the wear resistance, an electrical property etc. of the obtained charge transporting layer, it is preferable to use, for example, polycarbonate which contains bisphenol Z as the monomer ingredient (hereinafter referred to as "bisphenol Z polycarbonate"), and a mixture of bisphenol Z polycarbonate and other polycarbonate. The binder resin may be used each alone, or two or more of them may be used in combination.

The charge transporting layer preferably contains an antioxidant together with the charge transporting substance and the binder resin for charge transporting layer. Also for the antioxidant, substances used customarily in the relevant field can be used including, for example, Vitamin E, hydroquinone, hindered amine, hindered phenol, paraphenylene diamine, arylalkane and derivatives thereof, an organic sulfur compound, and an organic phosphorus compound. The antioxidants may be used each alone, or two or more of them may be used in combination. The content of the antioxidant is not particularly limited, and is 0.01% by weight to 10% by weight and preferably 0.05% by weight to 5% by weight of the total amount of the ingredients constituting the charge transporting layer. The charge transporting layer can be formed by dissolving or dispersing an appropriate amount of a charge transporting substance, binder resin and, optionally, an antioxidant, a plasticizer, a sensitizer, etc. respectively in an appropriate organic solvent which is capable of dissolving or dispersing the ingredients described above, to thereby prepare a coating solution for charge transporting layer, and applying the coating solution for charge transporting layer to the surface of a charge generating layer followed by drying. The thickness of the charge transporting layer obtained in this way is not particularly limited, and preferably 10 μm to 50 μm and more preferably 15 μm to 40 μm. Note that it is also possible to form a photosensitive layer in which a charge generating substance and a charge transporting substance are present in one layer. In this case, the kind and content of the charge generating substance and the charge transporting substance, the kind of the binder resin, and other additives may be the same as those in the case of forming separately the charge generating layer and the charge transporting layer.

In the embodiment, there is used a photoreceptor drum which has an organic photosensitive layer as described above containing the charge generating substance and the charge transporting substance. It is, however, also possible to use, instead of the above photoreceptor drum, a photoreceptor drum which has an inorganic photosensitive layer containing silicon or the like.

The charging section 12 faces the photoreceptor drum 11 and is disposed away from the surface of the photoreceptor drum 11 longitudinally along the photoreceptor drum 11. The charging section 12 charges the surface of the photoreceptor drum 11 so that the surface of the photoreceptor drum 11 has predetermined polarity and potential. As the charging section 12, it is possible to use a charging brush type charging device, a charger type charging device, a pin array type charging device, an ion-generating device, etc. Although the charging section 12 is disposed away from the surface of the photoreceptor drum 11 in the embodiment, the configuration is not limited thereto. For example, a charging roller may be used as the charging section 12, and the charging roller may be disposed in pressure-contact with the photoreceptor drum. It is also possible to use a contact-charging type charger such as a charging brush or a magnetic brush.

The exposure unit 13 is disposed so that a light beam corresponding to each color information emitted from the exposure unit 13 passes between the charging section 12 and the developing device 14 and reaches the surface of the photoreceptor drum 11. In the exposure unit 13, the image information is converted into light beams corresponding to each color information of black (b), cyan (c), magenta (m), and yellow (y), and the surface of the photoreceptor drum 11 which has been evenly charged by the charging section 12, is exposed to the light beams corresponding to each color information to thereby form electrostatic latent images on the surfaces of the photoreceptor drums 11. As the exposure unit 13, it is possible to use a laser scanning unit having a laser emitting portion and a plurality of reflecting mirrors. The other usable examples of the exposure unit 13 may include an LED array and a unit in which a liquid-crystal shutter and a light source are appropriately combined with each other.

Figure 3:
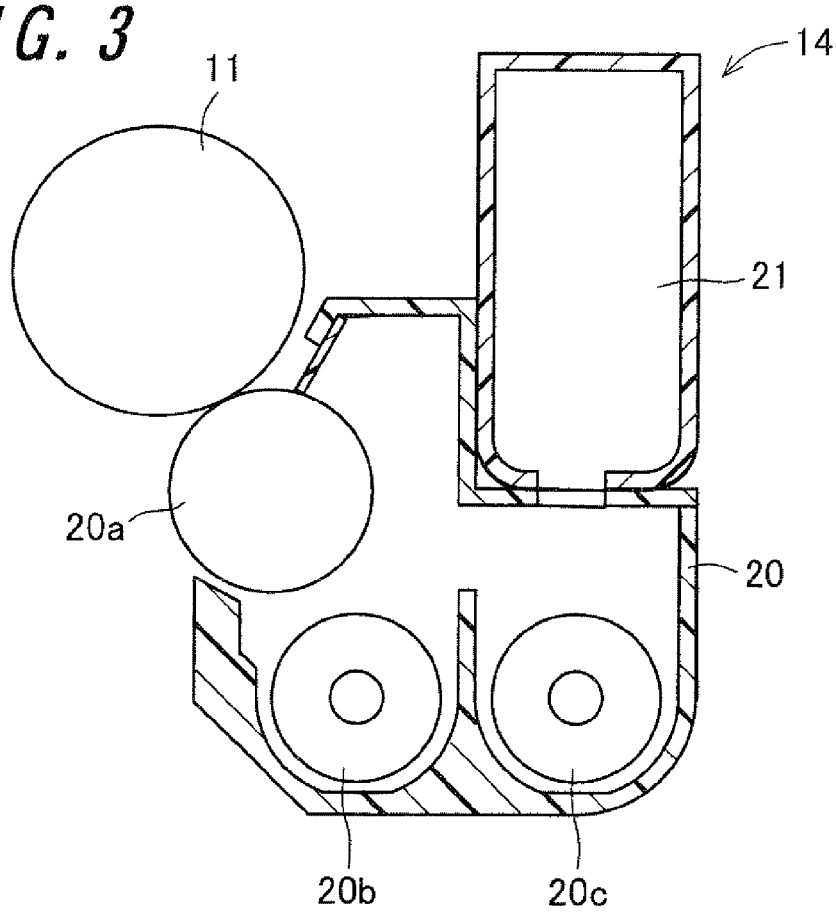
FIG. 3 is a sectional view schematically showing a configuration of a developing device according to the invention.

FIG. 3 is a sectional view schematically showing a configuration of a developing device 14 according to the invention. The developing device 14 includes a developing tank 20 and a toner hopper 21. The developing tank 20 is a container-shaped member which is disposed so as to face the surface of the photoreceptor drum 11 and used to supply a toner to an electrostatic latent image formed on the surface of the photoreceptor drum 11 so as to develop the electrostatic latent image into a visualized image, i.e. a toner image. The developing tank 20 contains in an internal space thereof the toner, and rotatably supports roller members such as a developing roller 20*a*, a supplying roller 20*b*, and an agitating roller 20*c*, or screw members, which roller or screw members are contained in the developing tank 20. The developing tank 20 has an opening in a side face thereof opposed to the photoreceptor drum 11. The developing roller 20*a* is rotatably provided at such a position as to face the photoreceptor drum 11 through the opening just stated. The developing roller 20*a* is a roller-shaped member for supplying a toner to the electrostatic latent image on the surface of the photoreceptor drum 11 in a pressure-contact portion or most-adjacent portion between the developing roller 20*a* and the photoreceptor drum 11. In supplying the toner, to a surface of the developing roller 20*a* is applied potential whose polarity is opposite to polarity of the potential of the charged toner, which serves as development bias voltage. By so doing, the toner on the surface of the developing roller 20*a* is smoothly supplied to the electrostatic latent image. Furthermore, an amount of the toner being supplied to the electrostatic latent image (which amount is referred to as "toner attachment amount") can be controlled by changing a value of the development bias voltage. The supplying roller 20*b* is a roller-shaped member which is rotatably disposed so as to face the developing roller 20*a* and used to supply the toner to the vicinity of the developing roller 20*a*. The agitating roller 20*c* is a roller-shaped member which is rotatably disposed so as to face the supplying roller 20*b* and used to feed to the vicinity of the supplying roller 20*b* the toner which is newly supplied from the toner hopper 21 into the developing tank 20. The toner hopper 21 is disposed so as to communicate a toner replenishment port (not shown) formed in a vertically lower part of the toner hopper 21, with a toner reception port (not shown) formed in a vertically upper part of the developing tank 20. The toner hopper 21 replenishes the developing tank 20 with the toner according to toner consumption. Further, it may be possible to adopt such configuration that the developing tank 20 is replenished with the toner supplied directly from a toner cartridge of each color without using the toner hopper 21.

The cleaning unit 15 removes the toner which remains on the surface of the photoreceptor drum 11 after the toner image has been transferred to the recording medium, and thus cleans the surface of the photoreceptor drum 11. In the cleaning unit 15, a platy member is used such as a cleaning blade. In the image forming apparatus 1 of the invention, an organic photoreceptor drum is mainly used as the photoreceptor drum 11. A surface of the organic photoreceptor drum contains a resin component as a main ingredient and therefore tends to be degraded by chemical action of ozone which is generated by corona discharging of the charging section. The degraded surface part is, however, worn away by abrasion through the cleaning unit 15 and thus removed reliably, though gradually. Accordingly, the problem of the surface degradation caused by the ozone, etc. is actually solved, and it is thus possible to stably maintain the potential of charges given by the charging operation over a long period of time. Although the cleaning unit 15 is provided in the embodiment, no limitation is imposed on the configuration and the cleaning unit 15 does not have to be provided.

In the toner image forming section 2, signal light corresponding to the image information is emitted from the exposure unit 13 to the surface of the photoreceptor drum 11 which has been evenly charged by the charging section 12, thereby forming an electrostatic latent image; the toner is then supplied from the developing device 14 to the electrostatic latent image, thereby forming a toner image; the toner image is transferred to an intermediate transfer belt 25; and the toner which remains on the surface of the photoreceptor drum 11 is removed by the cleaning unit 15. A series of toner image forming operations just described are repeatedly carried out.

The transferring section 3 is disposed above the photoreceptor drum 11 and includes the intermediate transfer belt 25, a driving roller 26, a driven roller 27, an intermediate transferring roller 28*b*, 28*c*, 28*m*, 28*y*, a transfer belt cleaning unit 29, and a transferring roller 30. The intermediate transfer belt 25 is an endless belt stretched between the driving roller 26 and the driven roller 27, thereby forming a loop-shaped travel path. The intermediate transfer belt 25 rotates in an arrow B direction. When the intermediate transfer belt 25 passes by the photoreceptor drum 11 in contact therewith, the transfer bias voltage whose polarity is opposite to the polarity of the charged toner on the surface of the photoreceptor drum 11 is applied from the intermediate transferring roller 28 which is disposed opposite to the photoreceptor drum 11 across the intermediate transfer belt 25, with the result that the toner image formed on the surface of the photoreceptor drum 11 is transferred onto the intermediate transfer belt 25. In the case of a multicolor image, the toner images of respective colors formed on the respective photoreceptor drums 11 are sequentially transferred and overlaid onto the intermediate transfer belt 25, thus forming a multicolor toner image. The driving roller 26 can rotate around an axis thereof with the aid of a drive mechanism (not shown), and the rotation of the driving roller 26 drives the intermediate transfer belt 25 to rotate in the arrow B direction. The driven roller 27 can be driven to rotate by the rotation of the driving roller 26, and imparts constant tension to the intermediate transfer belt 25 so that the intermediate transfer belt 25 does not go slack. The intermediate transferring roller 28 is disposed in pressure-contact with the photoreceptor drum 11 across the intermediate transfer belt 25, and capable of rotating around its own axis by a drive mechanism (not shown). The intermediate transferring roller 28 is connected to a power source (not shown) for applying the transfer bias voltage as described above, and has a function of transferring the toner image formed on the surface of the photoreceptor drum 11 to the intermediate transfer belt 25. The transfer belt cleaning unit 29 is disposed opposite to the driven roller 27 across the intermediate transfer belt 25 so as to come into contact with an outer circumferential surface of the intermediate transfer belt 25. When the intermediate transfer belt 25 contacts the photoreceptor drum 11, the toner is attached to the intermediate transfer belt 25 and may cause contamination on a reverse side of the recording medium, and therefore the transfer belt cleaning unit 29 removes and collects the toner on the surface of the intermediate transfer belt 25. The transferring roller 30 is disposed in pressure-contact with the driving roller 26 across the intermediate transfer belt 25, and capable of rotating around its own axis by a drive mechanism (not shown). In a pressure-contact portion (a transfer nip portion) between the transferring roller 30 and the driving roller 26, a toner image which has been carried by the intermediate transfer belt 25 and thereby conveyed to the pressure-contact portion is transferred onto a recording medium fed from the later-described recording medium feeding section 5. The recording medium carrying the toner image is fed to the fixing section 4. In the transferring section 3, the toner image is transferred from the photoreceptor drum 11 onto the intermediate transfer belt 25 in the pressure-contact portion between the photoreceptor drum 11 and the intermediate transferring roller 28, and by the intermediate transfer belt 25 rotating in the arrow B direction, the transferred toner image is conveyed to the transfer nip portion where the toner image is transferred onto the recording medium.

The fixing section 4 is provided downstream of the transferring section 3 along a conveyance direction of the recording medium, and contains a fixing roller 31 and a pressure roller 32. The fixing roller 31 can rotate by a drive mechanism (not shown), and heats the toner constituting an unfixed toner image carried on the recording medium so that the toner is fused to be fixed on the recording medium. Inside the fixing roller 31 is provided a heating portion (not shown). The heating portion heats the heating roller 31 so that a surface of the heating roller 31 has a predetermined temperature (heating temperature). For the heating portion, a heater, a halogen lamp, and the like device can be used, for example. The heating portion is controlled by the fixing condition controlling portion. In the vicinity of the surface of the faxing roller 31 is provided a temperature detecting sensor which detects a surface temperature of the fixing roller 31. A result detected by the temperature detecting sensor is written to a memory portion of the later-described control unit. The pressure roller 32 is disposed in pressure-contact with the fixing roller 31, and supported so as to be rotatably driven by the rotation of the fixing roller 31. The pressure roller 32 helps the toner image to be fixed onto the recording medium by pressing the toner and the recording medium when the toner is fused to be fixed on the recording medium by the fixing roller 31. A pressure-contact portion between the fixing roller 31 and the pressure roller 32 is a fixing nip portion. In the fixing section 4, the recording medium onto which the toner image has been transferred in the transfer section 3 is nipped by the fixing roller 31 and the pressure roller 32 so that when the recording medium passes through the fixing nip portion, the toner image is pressed and thereby fixed onto the recording medium under heat, whereby an image is formed.

The recording medium feeding section 5 includes an automatic paper feed tray 35, a pickup roller 36, conveying rollers 37, registration rollers 38, and a manual paper feed tray 39. The automatic paper feed tray 35 is disposed in a vertically lower part of the image forming apparatus 1 and in form of a container-shaped member for storing the recording mediums. Examples of the recording medium include plain paper, color copy paper, sheets for overhead projector, and postcards. The pickup roller 36 takes out sheet by sheet the recording mediums stored in the automatic paper feed tray 35, and feeds the recording mediums to a paper conveyance path S1. The conveying rollers 37 are a pair of roller members disposed in pressure-contact with each other, and convey the recording medium to the registration rollers 38. The registration rollers 38 are a pair of roller members disposed in pressure-contact with each other, and feed to the transfer nip portion the recording medium fed from the conveying rollers 37 in synchronization with the conveyance of the toner image carried on the intermediate transfer belt 25 to the transfer nip portion. The manual paper teed tray 39 is a device storing recording mediums which are different from the recording mediums stored in the automatic paper feed tray 35 and may have any size and which are to be taken into the image forming apparatus 1. The recording medium taken in from the manual paper feed tray 39 passes through a paper conveyance path S2 by use of the conveying rollers 37, thereby being fed to the registration rollers 38. In the recording medium feeding section 5, the recording medium supplied sheet by sheet from the automatic paper feed tray 35 or the manual paper feed tray 39 is fed to the transfer nip portion in synchronization with the conveyance of the toner image carried on the intermediate transfer belt 25 to the transfer nip portion.

The discharging section 6 includes the conveying rollers 37, discharging rollers 40, and a catch tray 41. The conveying rollers 37 are disposed downstream of the fixing nip portion along the paper conveyance direction, and convey toward the discharging rollers 40 the recording medium onto which the image has been fixed by the fixing section 4. The discharging rollers 40 discharge the recording medium onto which the image has been fixed, to the catch tray 41 disposed on a vertically upper surface of the image forming apparatus 1. The catch tray 41 stores the recording medium onto which the image has been fixed.

The image forming apparatus 1 includes a control unit (not shown). The control unit is disposed, for example, in an upper part of an internal space of the image forming apparatus 1, and contains a memory portion, a computing portion, and a control portion. To the memory portion of the control unit are input, for example, various set values obtained by way of an operation panel (not shown) disposed on the upper surface of the image forming apparatus 1, results detected from a sensor (not shown) etc. disposed in various portions inside the image forming apparatus 1, and image information obtained from an external equipment. Further, programs for operating various functional elements are written. Examples of the various functional elements include a recording medium determining portion, an attachment amount controlling portion, and a fixing condition controlling portion. For the memory portion, those customarily used in the relevant filed can be used including, for example, a read only memory (ROM), a random access memory (RAM), and a hard disk drive (HDD). For the external equipment, it is possible to use electrical and electronic devices which can form or obtain the image information and which can be electrically connected to the image forming apparatus 1. Examples of the external equipment include a computer, a digital camera, a television receiver, a video recorder, a DVD (digital versatile disc) recorder, an HDDVD (high-definition digital versatile disc), a blu-ray disc recorder, a facsimile machine, and a mobile computer. The computing portion of the control unit takes out the various data (such as an image formation order, the detected result, and the image information) written in the memory portion and the programs for various functional elements, and then makes various determinations. The control portion of the control unit sends to a relevant device a control signal in accordance with the result determined by the computing portion, thus performing control on operations. The control portion and the computing portion include a processing circuit which is achieved by a microcomputer, a microprocessor, etc. having a central processing unit. The control unit contains a main power source as well as the above-stated processing circuit. The power source supplies electricity to not only the control unit but also respective devices provided inside the image forming apparatus 1.

By forming images with use of the toner, two-component developer, developing device 14, and image forming apparatus 1 of the invention, it is possible to stably form high-quality images with good reproducibility over a long period of time.

EXAMPLES

Hereinafter, the invention will be specifically explained with reference to Examples and Comparative examples. In the following descriptions, "part" indicates "part by weight", and "%" indicates "% by weight", unless otherwise specified. Volume average particle sizes of sample particles in Examples and Comparative examples were measured as follows.

[Volume Average Particle Size]

To 50 ml of electrolyte: ISOTON II (trade name) manufactured by Beckman Coulter, Inc. were added 20 mg of a sample and 1 ml of alkyl ether sulfuric ester sodium, which were then subjected to a dispersion treatment at ultrasonic frequency of 20 kHz for three minutes, thereby preparing a measurement sample. The measurement sample was analyzed by a particle size distribution-measuring device: MULTISIZER III (trade name) manufactured by Beckman Coulter, Inc. under the conditions that an aperture diameter was 100 μm and the number of particles for measurement was 50,000 counts. A volume particle size distribution of the sample particles was thus obtained from which the volume average particle size was then determined.

Example 1

Step of Preparing Core Particles

Raw material monomers were synthesized with the aid of catalyst to obtain polyester resin. The raw material monomers were specifically 400 parts of polyoxypropylene(2.0)-2,2-bis(4-hydroxyphenyl)propane, 380 parts of polyoxyethylene(2.0)-2,2-bis(4-hydroxyphenyl)propane, and 330 parts of terephthalic acid. The catalyst was specifically 3 parts of dibutyltin oxide. The polyester resin thus obtained had a glass transition temperature (Tg) of 64° C. and a softening temperature (Tm) of 95° C. And then, as colorant, copper phthalocyanine (C.I. pigment blue 15:3) was added to the polyester resin. A thus-obtained material was melt-kneaded for 40 minutes by a kneader set at 140° C. As a result, a master batch was obtained which contains 40% by weight of the colorant. Note that polyoxypropylene(2.0)-2,2-bis(4-hydroxyphenyl)propane is an adduct in which 2.0 mol of propylene oxide is added on average to 1.0 mol of 2,2-bis(4-hydroxyphenyl)propane, and polyoxyethylene(2.0)-2,2-bis(4-hydroxyphenyl)propane is an adduct in which 2.0 mol of ethylene oxide is added on average to 1.0 mol of 2,2-bis(4-hydroxyphenyl)propane.

Next, the following materials were mixed and dispersed by a Henschel mixer for three minutes: 79.5 parts of the polyester resin (having a glass transition temperature (Tg) of 64° C. and a softening temperature (Tm) of 95° C.) which was the same as that used for the master batch; 12.5 parts of the master batch (having colorant concentration of 40%) prepared as above; and 8 parts of a releasing agent, i.e. carnauba wax (having a melting temperature of 82° C.). A raw material was thus obtained. Using a twin-screw extruder:PCM-30 (trade name) manufactured by Ikegai, Ltd., the raw material was then melt-kneaded and dispersed, resulting in a resin kneaded material. Note that operating conditions of the twin-screw extruder were set as follows: a temperature of cylinder was set at 110° C.; a barrel rotational speed was 300 rotations per minute (300 rpm); and a raw material-feeding speed was 20 kg/h. A toner kneaded material thus obtained was then cooled down by a cooling belt and coarsely pulverized by a speed mill having a screen which was 2 mm in opening diameter.

A coarsely-pulverized material thus obtained was when pulverized by an I-type jet mill and furthermore cleared of dust-size particles and coarse particles by using an elbow jet classifier, resulting in core particles which exhibited an average particle size of 6.9 μm.

<Step of Preparing Fine Resin Particles, Charge Control Agent, and Adhesion Aiding Agent>

As the fine resin particles, fine particles of styrene-butyl acrylate copolymer were prepared which had a volume average particle size of 0.1 μm and a glass transition temperature of 80° C. There was also prepared the charge control agent, i.e. Bontron E-84 (trade name) manufactured by Orient Chemical Industries, Ltd., which had a volume average particle size of 2 μm. Moreover, ethanol was prepared as the adhesion aiding agent.

<Step of Coating>

Into a surface-modifying device having a container in which a two-fluid nozzle for atomizing liquid was provided, 100 parts of the core particles, 5 parts of the fine resin particles, and 0.5 part (which is 10 parts based on 100 parts of the fine resin particles) of the charge control agent were put and left for 10 minutes at a rotational speed of 8,000 rpm. Note that the surface-modifying device was specifically HYBRIDIZATION SYSTEM NHS-1 (trade name) manufactured by Nara Machinery Co., Ltd. Subsequently, the surface-modifying nozzle was adjusted so that compressed air was fed to the two-fluid nozzle to atomize ethanol, which served as the adhesion aiding agent, at a rate of 0.5 g/min. The atomization then continued for 40 minutes, thereby coating the entire surfaces of the core particles with the fine resin particles.

The above coating formed of the fine resin particles and charge control agent became coating layers which cover the entire surfaces of the core particles. The core particles thus obtained were freeze-dried, resulting in a toner of Example 1.

Example 2

A toner of Example 2 was obtained in the same manner as Example 1 except that an amount of the charge control agent put in the step of coating was 0.025 part (which is 0.5 part based on 100 parts of the fine resin particles).

Example 3

A toner of Example 3 was obtained in the same manner as Example 1 except that an amount of the charge control agent put in the step of coating was 0.05 part (which is 1 part based on 100 parts of the fine resin particles).

Example 4

A toner of Example 4 was obtained in the same manner as Example 1 except that an amount of the charge control agent put in the step of coating was 5 parts (which is 100 parts based on 100 parts of the fine resin particles).

Example 5

A toner of Example 5 was obtained in the same manner as Example 1 except that an amount of the charge control agent put in the step of coating was 6 parts (which is 120 parts based on 100 parts of the fine resin particles).

Example 6

A toner of Example 6 was obtained in the same manner as Example 1 except that an amount of the fine resin particles put in the step of coating was 1 part and that an amount of the charge control agent put in the step of coating was 0.5 part (which is 50 parts based on 100 parts of the fine resin particles).

Comparative Example 1

A toner of Comparative example 1 was obtained in the same manner as Example 1 except that no charge control agent was put in the step of coating.

Table 1 collectively shows properties of the toners of Examples and Comparative examples.

Comparative Example 2

A toner of Comparative example 2 was obtained in the same manner as Example 1 except that no fine resin particles were put in the step of coating.

TABLE 1

| | Core particles | | Fine resin particles | | | Charge control agent | | | |
|---|---|---|---|---|---|---|---|---|---|
| | Particle size (μm) | Coefficient of variation (%) | Kind | Particle size (μm) | Parts | Particle size (μm) | Part based on 100 parts of toner | Part based on 100 parts of fine resin particles | Atomization of ethanol |
| Ex. 1 | 6.9 | 22 | Styrene-butyl acrylate polymer | 0.1 | 5 | 2 | 0.5 | 10 | Done |
| Ex. 2 | 6.9 | 22 | styrene-butyl acrylate polymer | 0.1 | 5 | 2 | 0.025 | 0.5 | Done |
| Ex. 3 | 6.9 | 22 | styrene-butyl acrylate polymer | 0.1 | 5 | 2 | 0.05 | 1 | Done |
| Ex. 4 | 6.9 | 22 | styrene-butyl acrylate polymer | 0.1 | 5 | 2 | 5 | 100 | Done |
| Ex. 5 | 6.9 | 22 | styrene-butyl acrylate polymer | 0.1 | 5 | 2 | 6 | 120 | Done |
| Ex. 6 | 6.9 | 22 | styrene-butyl acrylate polymer | 0.1 | 1 | 2 | 0.5 | 50 | Done |
| Comp. Ex. 1 | 6.9 | 22 | styrene-butyl acrylate polymer | 0.1 | 5 | 2 | 0 | 0 | Done |
| Comp. Ex. 2 | 6.9 | 22 | — | — | — | 2 | 0.5 | 10 | Done |

<Preparation of Two-Component Developer>

With 100 parts of the toners of Examples and Comparative examples obtained as described above, 0.7 part of silica particles and 1 part of titanium oxide were mixed, which silica particles had an average primary particle size of 20 nm and been hydrophobically treated with a silane coupling agent. The toner thus obtained is now referred to as externally-additive toner. The externally-additive toner was then mixed with ferrite core carriers having a volume average particle size of 60 μm in such an adjusted proportion that concentration of the externally-additive toner would become 4%, thereby preparing a two-component developer which had toner concentration of 4%.

(Evaluation)

Evaluations were carried out as follows with use of the toners of Examples and Comparative examples or the two-component developers containing the toners of Examples and Comparative examples.

[Coated State]

The coated state of the coating layer was checked as follows. First of all, the toner was embedded in epoxy resin curable at room temperature, resulting in a cured product which was then cut at plural positions by a microtome with diamond knives, thereby being formed into ultrathin slices each having a thickness of about 100 nm. These ultrathin slices were then stained with ruthenium and observed at 20,000-fold magnification by a transmission electron microscope: H-8100 (trade name) manufactured by Hitachi, Ltd. A cross-section of the toner was thus observed. Using image analysis software, the boundary lengths of the toner particles and the lengths of uncovered parts of the core particles were measured, and average values thereof were calculated. A proportion of the length of the covered part to the boundary length was determined as coverage. Evaluations were conducted according to the following criteria.

Good: The coverage was 80% or more.

Poor: The coverage was less than 80%.

[Dispersed State of Charge Control Agent]

The dispersed state of the charge control agent was checked as follows. First of all, the toner was embedded in epoxy resin curable at room temperature, resulting in a cured product which was then cut at plural positions by a microtome with diamond knives, thereby being formed into ultrathin slices each having a thickness of about 100 nm. These ultrathin slices were then observed at 20,000-fold magnification by the transmission electron microscope: H-8100 (trade name) manufactured by Hitachi, Ltd. A cross-section of the toner was thus observed. In this manner, a dispersion diameter of the dispersed charge control agent in the coating layer was measured. Evaluations were conducted according to the following criteria.

Good: The dispersion diameter of the dispersed charge control agent was less than 1 μm.

Poor: The dispersion diameter of the dispersed charge control agent was 1 μm or more.

[Chargeability]

(a) Charge-Rising Property

A 5 ml-glass bottle containing 0.95 g of a carrier (silicone-coated ferrite core carrier) and 0.05 g of a toner was agitated for one minute by a rotary shaker at a rate of 32 rpm. The two-component developer was then collected and an amount of charges therein was measured by a suction-type charge amount analyzer: 210H-2A Q/M METER (trade name) manufactured by TREK, INC. After another three minute-agitation, the charge amount was measured in the same manner. The charge-rising property was evaluated based on a difference $\Delta Q_1$ (μC/g) between the charge amount after a lapse of one minute and the charge amount after a lapse of three minutes. Evaluations were conducted according to the following criteria.

Good: Favorable. $5 \geqq |\Delta Q_1|$

Available: No problem for practical use. $7 \geqq |\Delta Q_1| > 5$

Poor: Defective. $|\Delta Q_1 > 7$ (b) Life Stability

The two-component developer prepared was put in a commercial copier having a two-component development system: MX-4500N (trade name) manufactured by Sharp Corporation which idled for three minutes at room temperature and normal humidity. The two-component developer was then collected and an initial amount of charges therein was measured by the suction-type charge amount analyzer: 210H-2A Q/M METER (trade name) manufactured by TREK, INC. Subsequently, at room temperature and normal humidity, solid images are printed on 50,000 sheets by the above copier. And then, the two-component developer was collected and an amount of charges therein was measured in the same manner.

The life stability was evaluated based on a difference $\Delta Q_2$ (μC/g) between the initial amount of charges and the charge amount after 50,000 copies were made. Evaluations were conducted according to the following criteria.

Good: Favorable. $5 \geqq |\Delta Q_2|$

Available: No problem for practical use. $7 \geqq |\Delta Q_2| > 5$

Poor: Defective. $|\Delta Q_2| > 7$ (c) Environment Dependence

The two-component developer prepared was put in the commercial copier having a two-component development system: MX-4500N (trade name) manufactured by Sharp Corporation, and solid images were thereby printed on 50,000 sheets in the H/H circumstance at high temperature (35° C.) and high humidity (80% RH) and in the L/L circumstance at low temperature (5° C.) and low humidity (10% RH). The two-component developer was then collected and an amount of charges therein was measured by the suction-type charge amount analyzer: 210H-2A Q/M METER (trade name) manufactured by TREK, INC.

The environment dependence was evaluated based on a difference $\Delta Q_3$ (μC/g) between the charge amount in the H/H circumstance at high temperature and high humidity and the charge amount in the L/L circumstance at low temperature and low humidity. Evaluations were conducted according to the following criteria.

Good: Favorable. $5 \geqq |\Delta Q_3|$

Available: No problem for practical use. $10 \geqq |\Delta Q_3| > 5$

Poor: Defective. $|\Delta Q_3 > 10$

[Fogging]

The two-component developer prepared was put in the commercial copier having a two-component development system: MX-4500N (trade name) manufactured by Sharp Corporation, and solid images were thereby printed on 50,000 sheets at room temperature and normal humidity. And then, an adhesive tape was used to collect the toner attached to a non-image part after a printing operation adjusted so as to have 0.4 mg/cm$^2$ of the toner attached to the photoreceptor. Image density (ID) of the toner thus collected was measured by a colorimeter: X-Rite 938 (trade name) manufactured by X-Rite, Inc. and used as a reference index. Evaluations were conducted according to the following criteria.

Good: Favorable. ID was less than 0.05.

Available: No problem for practical use. ID was 0.05 or more and less than 0.1.

Poor: Defective. ID was 0.1 or more.

[Comprehensive Evaluation]

On the basis of the evaluation results obtained as above, the comprehensive evaluation was carried out.

Good: No "Available" or "Poor" was given.

Available: One or more "Available" were given.

Poor: Two or more "Poor" were given.

Table 2 shows the evaluation results.

TABLE 2

| | | | Chargeability | | | | |
|---|---|---|---|---|---|---|---|
| | Coated state | Dispersed state | Charge rising property | Life stability | Environment dependence | Fogging | Comprehensive Evaluation |
| Ex. 1 | Good | Good | Good | Good | Good | Good | Good |
| Ex. 2 | Good | Good | Available | Good | Available | Good | Available |
| Ex. 3 | Good | Good | Good | Good | Good | Good | Good |
| Ex. 4 | Good | Good | Good | Good | Good | Good | Good |
| Ex. 5 | Good | Good | Good | Available | Good | Available | Available |
| Ex. 6 | Poor | Good | Available | Good | Available | Good | Available |
| Comp. Ex. 1 | Good | — | Available | Poor | Poor | Poor | Poor |
| Comp. Ex. 2 | — | — | Good | Poor | Poor | Poor | Poor |

The toners of Examples 1, 3, and 4 exhibited excellent chargeability and caused no fogging.

As compared to the toner of Example 1, the toner of Example 2 contained the charge control agent in a smaller proportion based on the amount of the fine resin particles and therefore exhibited a slower rise of charges and deteriorated environment dependence, but was practically available.

As compared to the toner of Example 1, the toner of Example 5 contained the charge control agent in a larger proportion based on the amount of the fine resin particles and therefore was more likely to have the fine resin particles and the charge control agent falling off the core particles, thus being degraded in the life stability, but was practically available.

As compared to the toner of Example 1, the toner of Example 6 contained the fine resin particles in a smaller proportion based on the amount of the core particles and therefore had the core particles with their smaller areas coated, and exhibited a slower rise of charges and deteriorated environment dependence, but was practically available.

As compared to the toner of Example 1, the toner of Example 7 had the charge control agent which was formed of smaller particles, and therefore aggregated and exhibited degraded life stability and environment dependence and moreover caused fogging, but was practically available.

The toner of Comparative example 1 contained no charge control agent and therefore exhibited degraded properties in all items as compared to the toners of Examples.

The toner of Comparative example 2 was not immobilized by the coating layer made of the fine resin particles and therefore exhibited degraded properties except its favorable charge rising property, as compared to the toners of Examples.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing a toner, comprising the steps of:

producing core particles comprising binder resin and colorant;

producing a charge control agent and fine resin particles comprising at least a resin, and preparing an adhesion aiding agent, the adhesion aiding agent increasing adhesion of the fine resin particles and the charge control agent to the core particles; and forming a resin coating layer comprising the charge control agent, wherein the core particles, the fine resin particles, and the charge control agent are agitated by the agitator while the adhesion aiding agent is aromized into the container, the adhesion aiding agent enabling the fine resin particles and the charge control agent to be attached to the surfaces of the core particles, using a surface modifying device, the surface modifying device including: a container for storing the core particles, the fine resin particles, and the charge control agent; an agitator for agitating the core toner, the fine resin particles, and the charge control agent inside the container; and an atomizer for atomizing the adhesion aiding agent into the container.

2. The method of claim 1, wherein the resin contained in the coating layer is formed of fine resin particles, and at least a part of the fine resin particles is melt-bonded to adjacent fine resin particles.

3. The method of claim 1, wherein a surface area of the core particle covered with the coating layer is 80% or more and 100% or less of a total surface area of the core particle.

4. The method of claim 1, wherein a content of the charge control agent is 1 part by weight or more and 100 parts by weight or less based on 100 parts by weight of the fine resin particles.

5. The method of claim 1, wherein the charge control agent is at least one or more of metal complex or metal salt of salicylic acid and a derivative thereof, metal complex or metal salt of bisdiphenylglycolic acid and a derivative thereof, and charge control resin.

6. The method of claim 1, wherein the core particles have a volume average particle size of 3 μm or more and 10 μm or less.

7. The method of claim 1, wherein the fine resin particles have a volume average particle size of 0.05 μm or more and 1 μm or less.

8. The method of claim 1, wherein the adhesion aiding agent includes water or lower alcohol.

9. The method of claim 1, wherein the charge control agent in the resin coating layer has a dispersion diameter of less than 1 μm.

* * * * *